US009754454B2

(12) United States Patent
Onorato et al.

(10) Patent No.: US 9,754,454 B2
(45) Date of Patent: Sep. 5, 2017

(54) METHOD AND SYSTEM FOR LOTTERY APPLICATION

(71) Applicant: MLA Group, LLC, Cleveland, OH (US)

(72) Inventors: Salvatore C. Onorato, Kirtland, OH (US); Vincent S. Onorato, New York, NY (US)

(73) Assignee: MLA GROUP, LLC, Cleveland, OH (US)

( * ) Notice: Subject to any disclaimer, the term of this patent is extended or adjusted under 35 U.S.C. 154(b) by 81 days.

(21) Appl. No.: 14/939,180

(22) Filed: Nov. 12, 2015

(65) Prior Publication Data

US 2016/0189467 A1 Jun. 30, 2016

Related U.S. Application Data

(60) Provisional application No. 62/079,261, filed on Nov. 13, 2014.

(51) Int. Cl.
*G07F 17/32* (2006.01)
*G07F 17/42* (2006.01)

(52) U.S. Cl.
CPC ..... *G07F 17/329* (2013.01); *G07F 17/3223* (2013.01); *G07F 17/3225* (2013.01); *G07F 17/42* (2013.01)

(58) Field of Classification Search
CPC ..... G07F 17/329; G07F 17/42; A63F 3/0045; A63F 3/065; G07C 15/00; G07C 15/005; G07C 15/006
See application file for complete search history.

(56) References Cited

U.S. PATENT DOCUMENTS 5,276,312 A 1/1994 McCarthy

FOREIGN PATENT DOCUMENTS

EP 0627949 4/1999
EP 0956117 11/1999

*Primary Examiner* — Damon Pierce
(74) *Attorney, Agent, or Firm* — Tucker Ellis LLP; Carlos Garritano

(57) ABSTRACT

Systems and methods of the invention relate to integrating into an existing hard copy lottery ticket system for adaptation to sell soft copies of lottery tickets. A master virtual device can provide data communications related to a sale of a soft copy of a lottery ticket to a master terminal such that the master terminal processes the sale to a lottery authority as if the sale is for a hard copy of the lottery ticket. The master virtual device can include a virtual lottery application that is configured to receive data related to a request to purchase a soft copy of a lottery ticket, format and communicate such data to the master terminal, and communicate confirmation of the soft copy of the lottery ticket.

19 Claims, 13 Drawing Sheets

METHOD AND SYSTEM FOR LOTTERY APPLICATION

CROSS-REFERENCE TO RELATED APPLICATIONS

This application claims the benefit of U.S. Provisional Application Ser. No. 62/079,261, filed Nov. 13, 2014, and entitled "METHOD AND SYSTEM FOR VIRTUAL LOTTERY APPLICATION." The entirety of the aforementioned application is incorporated herein by reference.

BACKGROUND

Technical Field

Embodiments of the subject matter disclosed herein relate to a lottery ticket electronic retail system that leverages an existing master terminal of a retailer which allows purchases of lottery tickets to be credited to each retailer.

Discussion of Art

A lottery authority provides a gaming service in which a player can purchase a printed ticket and gambles on winning a prize or sum of money. Often, the lottery authority will authorize merchants at various physical locations to sell printed tickets (e.g., lottery tickets). Lottery authorities offer various types of games such as instant games and draw games, and interactive electronic games. Instant games are typically a physical "scratch-off" ticket to which the player must scratch all or a portion of the physical ticket to reveal whether the player wins. After the physical ticket reveals whether the player wins, the result is "instantly" determined. Draw games typically have a set date/time at a frequency in which numbers are drawn by random. A player in a draw game either manually selects or has a computer randomly select numbers for his/her purchased lottery ticket. The player then compares the selected numbers on his/her purchased lottery ticket to the numbers drawn on the particular date/time. Interactive electronic games are games of chance in which a user can enter and interact or play the game through an electronic device (e.g., mobile device, computer, laptop, desktop, tablet, video game console, portable gaming device, a device with a user input and a display, among others).

Merchants often manage the sale and distribution of the lottery tickets from a physical location (e.g., store, market, etc.). The merchant is compensated with a percentage of the sales from the physical location. In other words, each merchant's compensation is dependent on where the ticket is physically purchased, whereas the lottery authority is compensated regardless of where the lottery ticket is sold. Such distribution systems often include physical terminals at a physical location. For example, a master terminal is in communication with a lottery authority from which a hard copy of a lottery ticket can be sold, printed, and distributed. Following such example, often an employee operates the master terminal to sell, print, and distribute the hard copy lottery tickets to players. In another example, a slave terminal can be coupled to a master terminal in which hard copy sales of lottery tickets are made from each. Following such example, often a player operates the slave terminal to provide payment and receive a hard copy of a lottery ticket.

It may be desirable to improve the existing lottery system.

BRIEF DESCRIPTION

In an embodiment, a system is provided that integrates into an existing hard copy lottery ticket system for adaptation to sell soft copies of lottery tickets. A master virtual device can provide data communications related to a sale of a soft copy of a lottery ticket to a master terminal such that the master terminal processes the sale to a lottery authority as if the sale is for a hard copy of the lottery ticket. The master virtual device can include a virtual lottery application that is configured to receive data related to a request to purchase a soft copy of a lottery ticket, format and communicate such data to the master terminal, and communicate confirmation of the soft copy of the lottery ticket.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
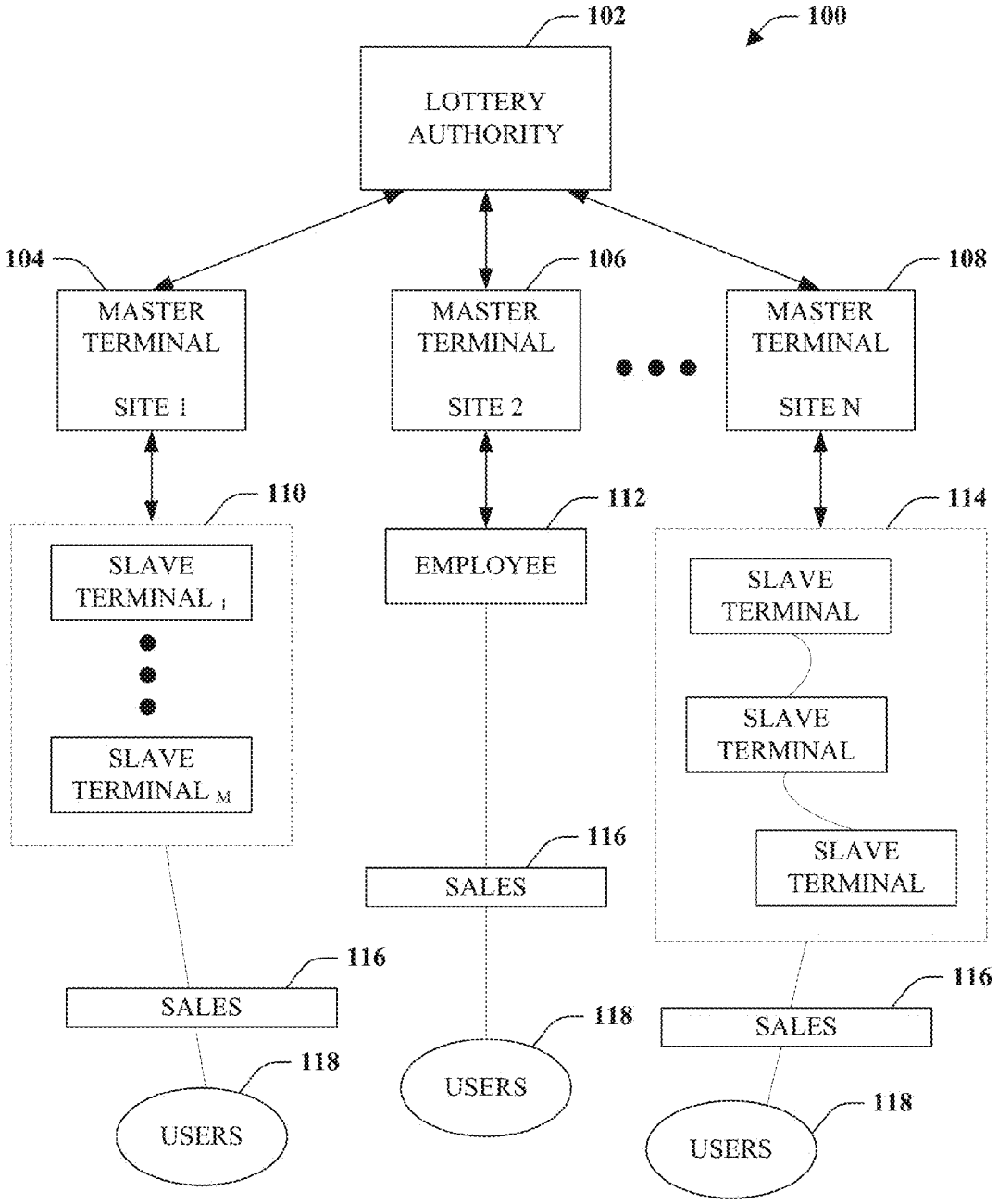
FIG. 1 is an illustration of a system that sells lottery tickets from a lottery authority through a merchant.

Embodiments of the innovation relate to methods and systems for integrating into an existing hard copy lottery ticket system for adaptation to sell soft copies of lottery tickets. A master virtual device can provide data communications related to a sale of a soft copy of a lottery ticket to a master terminal such that the master terminal processes the sale to a lottery authority as if the sale is for a hard copy of the lottery ticket. In other words, the lottery authority and the master terminal would handle and process the data communications for the sale of the soft copy of the lottery ticket as if such sale was for a hard copy of the lottery ticket. The master virtual device can include a virtual lottery application that is configured to receive data related to a request to purchase a soft copy of a lottery ticket, format and communicate such data to the master terminal, and communicate confirmation (received from the master terminal via the lottery authority) of the soft copy of the lottery ticket.

The subject innovation utilizes a first data connection and a second data connection. The second data connection can be utilized by the virtual lottery application and configured to collect one or more requests for a sale of a soft copy of a lottery ticket (e.g., a second set of requests) and communicate the one or more requests to the master terminal. The first data connection can be utilized by the master terminal and configured to transmit data to the lottery authority. Thus, the first data connection is used for communication between the master terminal and the lottery authority (and in some cases between the slave terminal and the lottery authority). In such example, the first data connection can be a direct connection to the lottery authority and the second data connection can be a direct connection to the Internet and, in turn, mobile devices.

The master virtual device and the virtual lottery application can be configured to receive a second set of requests (for a sale of a soft copy of a lottery ticket) and deliver the request to the master terminal via the second data connection, wherein the master terminal can process the first set of requests (for sales of a hard copy of a lottery ticket) and/or the second set of requests (for sales of a soft copy of a lottery ticket) to the lottery authority via the first data connection. The virtual lottery application can receive the second set of requests (related to a soft copy lottery ticket) and configure the second set of requests to a format similar to the first set of requests for a hard copy of a lottery ticket. The configured second set of requests can be communicated to the lottery authority with the first set of requests to receive either a confirmation or rejection for a lottery ticket. Upon receipt of the confirmation, the lottery ticket or lottery ticket information can be output in the format defined by the origination of the set of requests (e.g., the first set of requests for a hard copy or the second set of requests for a soft copy).

The virtual lottery application can further include package module that collects and creates a data package with data representative of a request for a sale of a soft copy of a lottery ticket where the request is from a mobile device. The data package can be created and communicated to the master terminal. Upon receipt, the master terminal can process the request for the sale with the lottery authority and receive a confirmation.

The virtual lottery application can further include a format module that is configured to format the data package. The format module can employ a format to the data package with data representative of a request for a sale of a soft copy of the lottery ticket, wherein the format is a master-slave format for data that is communicated from a slave terminal to the master terminal. In other words, the format module can evaluate data communicated from a slave terminal to a master terminal and replicate the data (e.g., format, size, type, content, etc.) for use with the virtual lottery application and the master terminal. Thus, the data from the virtual lottery application can be handled and processed by the master terminal as if such data was from the slave terminal.

The virtual lottery application can further include a security module that is configured to employ one or more security protocols for communications between a mobile device and the virtual lottery application and/or the virtual lottery application and the master terminal. By way of example and not limitation, a first set of security protocols can be employed for communications between 1) the master terminal and the slave terminal; and 2) the master terminal and the virtual lottery application. In such example, a second set of security protocols can be employed for communications between one or more mobile devices and the virtual lottery application.

The virtual lottery application can further include a transaction module that is configured to perform data communications related to receiving payment and transmitting a soft copy of a lottery ticket for such received payment. The transaction module can provide data communications between the virtual lottery application, a mobile device, an e-commerce account, a bank account, an online money account, and the like.

The virtual lottery application can further include a retailer track module that is configured to utilize an identification for the virtual lottery application in which the identification is representative of a merchant using the master terminal to which the virtual lottery application is in data communication. In an embodiment, the virtual lottery application can utilize the same identification that is used with a master terminal. In another embodiment, the master terminal can utilize a first identification and the virtual lottery application can utilize a second identification, wherein the second identification is referenced to the first identification so as to index a merchant using the master terminal. The retailer track module can correspond an identification to a sale of a soft copy of a lottery ticket such that a merchant using the master terminal is known and tracked for the sale. Such identification can be utilized to maintain compensation schemes related to the sale of hard copies of the lottery tickets.

The virtual lottery application can further include a throttle module that is configured to adjust an amount of requests communicated to a master terminal, wherein the amount of request are from one or more mobile devices and each request is for a sale of a soft copy of a lottery ticket. In particular, the throttle module can manage a threshold for the amount of request in which the communicated requests can be stopped, allowed, and/or throttled (e.g., time released, batch released, a queue, etc.). By way of example and not limitation, the throttle module can be configured to regulate the amount of requests communicated to the master terminal based on a time, a date, a range of time, a time of a draw for a lottery game, a date of a draw for a lottery game, among others. In general, the throttle module can be configured to communicate requests for sales of soft copies of the lottery tickets to the master terminal without causing an overload (e.g., exceeding a number of total requests the master terminal can communicate to the lottery authority) of requests from the master terminal to the lottery authority.

The virtual lottery application can further include a settings module that is configured to receive inputs for various parameters for the virtual lottery application, wherein the inputs can be automatically identified, defined by a user, or a combination thereof. In an embodiment of automatically identifying a setting, the settings module can evaluate a master terminal to which data connectivity is established and collect one or more inputs for one or more parameters. By way of example and not limitation, the following inputs can be collected from the master terminal: flow of data requests to a lottery authority (e.g., a maximum amount of requests that can be sent, a frequency of when a request can be sent, and the like); an identification number of a merchant or location using the master terminal; an Internet connection input (e.g., wired connection setting, wireless connection setting, IP address, SSID, gateway ID, among others); among others.

Conventionally, the sale of lottery tickets are in physical or hard copy form and are purchased by a player or user "in-person." Lottery authorities often incentivize merchants to sell their lottery tickets by providing a commission or percentage of the sales of the hard copy lottery tickets. The subject innovation is directed to integrate within an existing lottery authority system and adapt such existing lottery authority system to perform sales of soft copies of lottery tickets without disrupting the hardware configuration, data communication, infrastructure, and/or merchant incentives.

With reference to the drawings, like reference numerals designate identical or corresponding parts throughout the several views. However, the inclusion of like elements in different views does not mean a given embodiment necessarily includes such elements or that all embodiments of the invention include such elements.

The term "lottery authority" as used herein can be defined as an entity that offers a service of gambling in the form of a lottery game, wherein a lottery ticket for the lottery game is sold and the lottery ticket includes a chance of winning money. In an example, the lottery authority can be state-owned, federal-owned, privately owned, privately owned and state sponsored, or a combination thereof. The term "lottery authority device" as used herein can be defined as a component or device that communicates data to and/or from the lottery authority.

The term "master terminal" as used herein can be defined as a device at a physical site that communicates with a lottery authority to process a transaction for a lottery ticket for a lottery game, wherein the transaction is completed by an employee of the merchant. In an embodiment, the master terminal can be approved or authorized by the lottery authority.

The term "slave terminal" as used herein can be defined as a device at a physical site that communicates with a lottery authority or a master terminal to process a transaction for a lottery ticket for a lottery game, wherein the transaction is completed by a player at the merchant's physical site. In an embodiment, the slave terminal can be approved or authorized by the lottery authority.

The term "hard copy" as used herein can be defined as a permanent reproduction, or copy, in the form of a physical object, wherein the physical object can be paper.

The term "soft copy" as used herein can be defined as an unprinted electronic file that can be displayed on a computing device.

The term "merchant" as used herein can be defined as a seller that provides a service of selling of at least a lottery ticket for a lottery game controlled by a lottery authority, wherein the seller performs such service at a physical location or site. In an embodiment, the merchant can be approved or authorized by the lottery authority to broker lottery tickets for lottery games.

The term "component" as used herein can be defined as a portion of hardware, a portion of software, or a combination thereof. A portion of hardware can include at least a processor and a portion of memory, wherein the memory includes an instruction to execute.

A lottery ticket for a lottery game, as used in the subject innovation, can be an entry to participate in a game of chance. The lottery ticket can be in electronic or paper format. The lottery ticket in a paper format can include numbers, symbols, characters, letters, pictures, images, words, and the like. The lottery ticket in an electronic format can include displayed images, displayed words, displayed pictures, displayed characters or symbols, audible sounds, haptic feedback, and the like. For example, a paper lottery ticket can include a scratch-off game in which a user scratches or removes a layer on the lottery ticket to expose certain areas in which a winning combination is placed. In another example, the paper lottery ticket that is a scratch-off game can be replicated with an electronic lottery ticket in which a user scratches with a touchscreen or input device to expose areas on the electronic lottery ticket displayed.

Moreover, the game of chance, as used in the subject innovation, can be a lottery draw game (e.g., a number drawing in which matching numbers from a lottery ticket to the drawn numbers is a winner), a scratch-off game (e.g., pre-defined tickets with winning combinations included with the lottery ticket and no drawing is required), an interactive electronic game of chance, and the like. By way of example and not limitation, games of chance can be, but are not limited to, Keno, BINGO, virtual slot machine games, virtual scratch-off games, mobile games, color-match games, match three games, matching games, among others. For example, an interactive video game can be installed on a device, wherein the purchase of a lottery ticket is an entry to enter the game of chance (here, the interactive video game). Upon playing the interactive video game, the user can cash out his/her winnings or money. The interactive video game can issue a lottery ticket for entry to participate in the interactive video game of chance or electronic game of chance and use the lottery ticket to cash out. The subject innovation can be employed with various games of chance that use an entry to participate or enter. It is to be appreciated that the subject innovation can be implemented with interactive video games, mobile games, draw games, scratch-off games, among others.

FIG. 1 is an illustration of a system 100 that sells lottery tickets from a lottery authority through a merchant. The system 100 can include a lottery authority 102 that controls and manages a lottery game, such as a draw game, in which random numbers are drawn and the drawn numbers are considered a winning numbers. The lottery authority 102 can include one or more components or devices which are referred herein as a "lottery authority device" that communicate data to and/or from the lottery authority 102 on its behalf. Users can purchase one or more lottery tickets with random selected numbers or user selected numbers for the draw game. For example, the lottery authority 102 can be managed or controlled by a state, a government, one or more states, one or more governments, a private company, or a combination thereof.

The lottery authority 102 can be in electronic communication with one or more master terminals, each at a site or physical location, and each configured to output a hard copy of a lottery ticket for the draw game. As depicted, master terminal 104 can be physically located at site 1, a master terminal 106 can be at site 2, and a master terminal 108 can be at site N (collectively referred to as "master terminals"), where N is a positive integer and is representative of how there can be multiple master terminals at multiple sites or physical locations. Moreover, there can be more than one master terminal at each site. Yet, each master terminal can track the number of sales for the draw game so as to track the number of sales for each site or physical location by storing sales data. For instance, the sales data for master terminals, representative of hard copy sales of tickets, can be stored as at least one of a portion of data, a data bit, a string of data, among others. In an example, the stored data, representative of hard copy sales, can be used to deliver compensation (e.g., funds, money, and the like) to encourage and/or reward sites or physical locations to sell lottery tickets.

Each of the master terminals can output a hard copy of a lottery ticket for a draw game once a request for such lottery ticket is confirmed by the lottery authority 102. In general, there are two embodiments with the system 100 in which a hard copy lottery ticket is sold to a user. It is to be appreciated that such embodiments are for example only and are not to be limiting on the subject innovation. In a first embodiment, a master terminal outputs a hard copy of the lottery ticket directly. For instance, an employee 112 can take requests from users 118 and provide sales 116 via the master terminal. In a second embodiment, a slave terminal is in electronic communication with a master terminal and the slave terminal allows a user to directly interact to complete sales 116. For instance, upon user input, the slave terminal can communicate to the master terminal and the master terminal can then communicate to the lottery authority to receive a confirmation. Further, in the second embodiment, sales 118 can be completed through the master terminal (via an employee handling the transaction) or the slave terminal (via a user providing a request). It is to be appreciated that the master terminal is in communication with the lottery authority 102 via a first data connection and the slave terminal is in communication with the associated or corresponding master terminal.

As illustrated in FIG. 1, the system 100 includes the master terminal 104 with one or more slave terminals 110 that can include slave terminal$_1$ to slave terminal$_M$, where M is positive integer. The one or more slave terminals 110 can generate sales 116 directly to users 118. Thus, there can be one or more slave terminals in communication with a master terminal at a site. It is to be appreciated that the master terminal 104 can output a hard copy of the lottery ticket to the users 118 as well as the one or more slave terminals can output a hard copy of the lottery ticket to the users 119. The master terminal 106 can output a hard copy of a lottery ticket in which employee 112 completes sales 116 to users 118. In such example, the employee 112 can receive a request from a user and submit the request to the lottery authority 102 via the first data connection. Upon confirmation from the lottery authority 102 for the request and/or approval of payment (e.g., verification of funds, cash, etc.), the master terminal 106 can output a hard copy of the lottery ticket that satisfies the request from the user. FIG. 1 further illustrates the master terminal 108 can be in communication with three slave terminals 114 which provide sales 116 to users 118.

Figure 2:
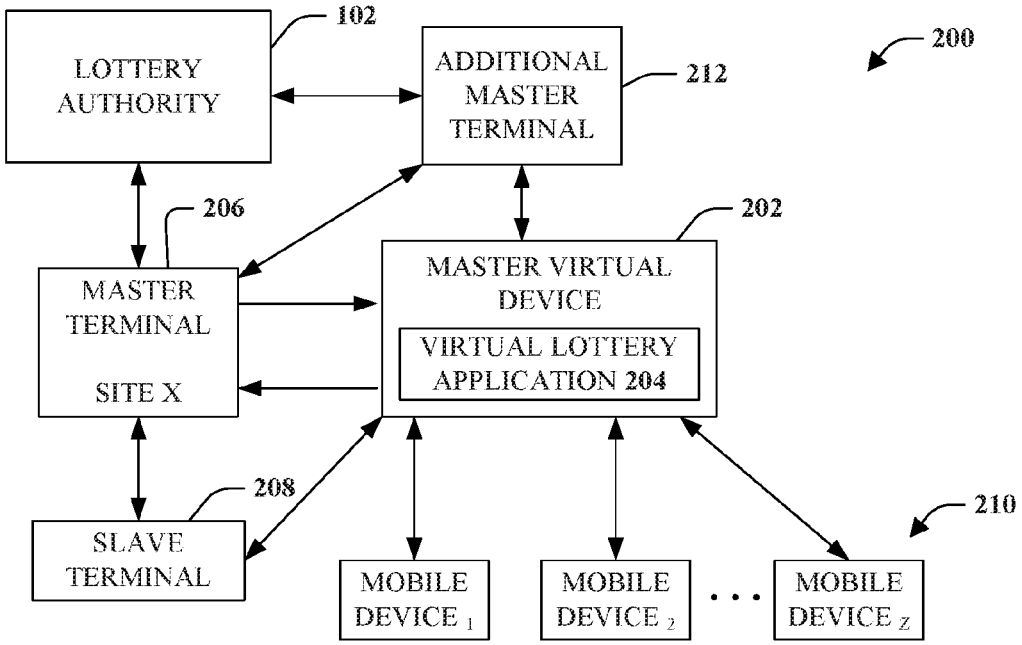
FIG. 2 is an illustration of a system that couples a master virtual device to an existing master terminal in order to provide sales of soft copies of lottery tickets.

Turning to FIG. 2, a system 200 is illustrated that couples a master virtual device to an existing master terminal in order to provide sales of soft copies of lottery tickets. The system can include a master virtual device 202 that is in electronic communication with a master terminal 206 that is in communication with the lottery authority 102 via a first data connection. The master terminal 206 can communicate a first set of requests for a hard copy of a lottery ticket to the lottery authority 102. The master virtual device 202 can collect a second set of requests to purchase a soft copy of a lottery ticket in which the request is collected via second data connection such as the Internet. It is to be appreciated that the first set of requests can be one or more requests to purchase or release a lottery ticket (hard copy). The lottery authority 102 can receive requests one-at-a-time or batch receipt, wherein the first set of requests can be tailored to match the requirements of the lottery authority 102. It is to be appreciated that the second set of requests can be one or more requests to purchase or release a lottery ticket (soft copy). The lottery authority 102 can receive requests one-at-a-time or batch receipt, wherein the second set of requests can be tailored to match the requirements of the lottery authority 102. The master terminal 206 can receive the first set of requests and the second set of requests and communicate the requests to the lottery authority 102 to receive corresponding lottery tickets for each request. However, rather than creating hard copy of the lottery tickets for each request, a hard copy of a lottery ticket is produced if the request is one of the first set of requests and a soft copy of a lottery is produced if the request is one of the second set of requests.

In particular, the master virtual device 202 can communicate the second set of requests for a soft copy of a lottery ticket to the master terminal 206, wherein the master terminal 206 can communicate the first set of requests and the second set of requests to the lottery authority 102 in order to receive confirmation (which approves the request and results in a lottery ticket or lottery ticket information) or a rejection (which disapproves of the request which results in no lottery ticket or no lottery ticket information). The confirmation can include a set of numbers for the draw game in which the set of numbers can be auto-generated numbers (generated by the lottery authority 102) or user selected numbers. The first set of requests and the second set of requests are handled by the master terminal 206 such that, upon receipt by the lottery authority 102, the set of requests are processed and a response is generated, wherein the response can be, for example, a confirmation or a rejection. Upon confirmation and approval of the first set of requests, the master terminal 206 can output a hard copy of a lottery ticket for the first set of requests (e.g., representative of a request for a hard copy of a lottery ticket for the draw game). If the communication from the lottery ticket authority 102 is a rejection, the master terminal 206 may not output a hard copy for a lottery ticket for the draw game.

Further upon receipt of the confirmation or rejection from the lottery authority 102 for the second set of requests, the master terminal 206 can communicate the confirmation or rejection to the master virtual device 202. The master virtual device 202 can output a soft copy of a lottery ticket for the second set of requests (e.g., representative of a request for a soft copy of a lottery ticket for the draw game) if the communication is a confirmation or approval. If the communication is a rejection, the master virtual device 202 may not output a soft copy for a lottery ticket for the draw game.

In an embodiment, the communication or output of the soft copy of the lottery ticket can be to the mobile device. In another embodiment, the soft copy of the lottery ticket can be communicated to an email address, an Internet Protocol (IP) address, a website, a smartphone number, a short-messaging-service (SMS), a social media service, a cloud-computing service, a cloud-storage service, a hard drive, a cloud-storage drive, and the like.

The system 200 can track sales related to lottery tickets and in particular, track sales for each master terminal, each slave terminal, each master virtual device, each sale made via the virtual lottery application, and for each location in which a sale of lottery tickets may occur. For example, the system 200 can store a number of sales, the retailer or location from where the sale was purchased, a terminal from where the sale was purchased (e.g., master terminal, master virtual device, slave terminal, etc.), and a type of ticket that was sold (e.g., soft copy or hard copy). By way of example, a first data portion (e.g., a bit, a number of bits, etc.) can be utilized to represent a number of hard copy lottery ticket sales from the master terminal 206 and/or slave terminal 208 and a second data portion (e.g., bit, a number of bits, etc.) can be utilized to represent a number of soft copy lottery ticket sales via the master virtual device 202. It is to be appreciated that a number of data portions can be used to store specific data related to the system 200 and such data portions can be pre-defined or user-selected so as to allow customization of the system 200.

In another example, each of the master terminal, slave terminal and/or master virtual device can have an assigned reference code (e.g., a sequence of symbols, numbers, letters, and the like), wherein the reference code can be tracked for each lottery ticket purchased. In another example, a location code (e.g., a sequence of symbols, numbers, letters, and the like) can be assigned to each retail location that manages or owns the device (e.g., master terminal, slave terminal, virtual lottery application, master virtual device, etc.) that completes the sale of the lottery ticket. The reference code and/or location code can be stored and referenced in order to determine which entity (e.g., store, store owner, retailer, etc.) made a sale of a lottery ticket (hard copy and/or soft copy). The reference code and/or location code can further be used to distribute payments or commission payments for the sale of lottery tickets.

The master virtual device 202 can include a virtual lottery application 204. The virtual lottery application 204 can be an executable computer program that can execute on a machine (e.g., the master virtual device 202, for example) in order to process the second set of requests for a sale of a soft copy of a lottery ticket in which the second set of requests are received from one or more mobile devices 210. There can be one or more mobile devices 210 such as mobile $device_1$ to mobile $device_Z$, where Z is a positive integer.

It is to be appreciated that the master virtual device 202 and/or the virtual lottery application 204 can format the second set of requests to a format of the first set of requests utilized by the master terminal 206 in order to facilitate handling and/or processing by the lottery authority 102. Further, it is to be appreciated that there can be one or more master virtual devices in electronic communication with the master terminal 206 and a 1:1 ratio is not to be limiting on the subject innovation. In an embodiment, a spawn module can be configured to generate an additional virtual lottery application in order to process additional second sets of requests from mobile devices 210.

In still another embodiment, the master terminal 206 and/or the slave terminal 208 can include the virtual lottery application 204. The virtual lottery application 204 can be an executable computer program that can execute on the master terminal 206 and/or the slave terminal 208 in order to process the second set of requests for a sale of a soft copy of a lottery ticket. In this embodiment, the master terminal 206 and/or the slave terminal 208 can receive and process the first set of requests for a sale of a hard copy of a lottery ticket and the second set of requests for a sale of a soft copy of a lottery ticket. Moreover, the second set of requests can be received from the one or more mobile device 210, the slave terminal 208, and/or the master terminal 206. In other words, this embodiment implements the virtual lottery application 204 on the existing lottery components and in particular, the master terminal 206 and/or the slave terminal 208 (if applicable in the system).

By way of example and not limitation, the data communications used with the system 200 can be wired and/or wireless. In particular, a wireless communication, a wired communication or a combination thereof can be used with at least one of the master terminal, the slave terminal, the lottery authority, the master virtual device, the virtual lottery application, or one or more mobile devices.

In an embodiment, the virtual lottery application 204 can be executed by a processor and/or memory of the master terminal 206. In still another embodiment, the virtual lottery application 204 can be executed by a processor and/or memory of the slave terminal 208. In yet another embodiment, the virtual lottery application 204 can be executed by a processor and/or memory of the mobile device, wherein the mobile device interacts directly with the lottery authority 102.

Figure 3:
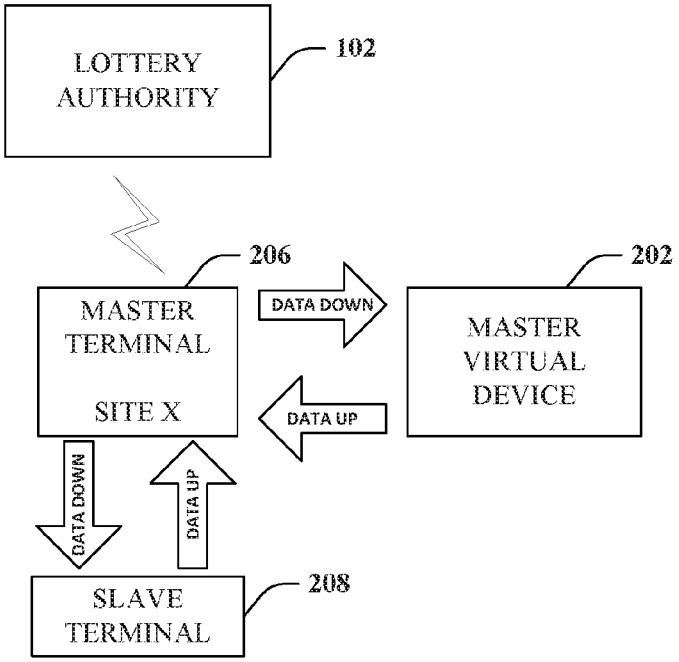
FIG. 3 is an illustration of an embodiment of data communications between a lottery authority, a master terminal, and a master virtual device.

FIG. 3 illustrates a system 300 in which data communications between the master virtual device 202 and the master terminal 206 are configured to replicate data communications between the master terminal 206 and the slave terminal 208 in order to allow the master terminal 206 communicate the first set of requests and the second set of requests to the lottery authority 102 for processing. For instance, the master terminal 206 and the slave terminal 208 can include first data communications, related to the first set of request for a hard copy of a lottery ticket, such as an upstream of data (e.g., from the slave terminal 208 to the master terminal 206) and a downstream of data (e.g., from the master terminal 206 to the slave terminal 208). Moreover, the master terminal 206 and the master virtual device 202 can include second data communications, related to the second set of requests for a soft copy of a lottery ticket, such as an upstream of data (e.g., from the master virtual device 206 to the master terminal 206) and a downstream of data (e.g., from the master terminal 206 to the master virtual device 206). The master virtual device 206 can replicate the first data communication with the second data communication so that the master terminal 206 can handle the second set of requests as the first set of requests when communicating with the lottery authority 102. It is to be appreciated that "data up" is referenced in FIG. 3 and corresponds to "upstream of data" and "data down" is referenced in FIG. 3 and corresponds to "downstream of data."

By way of example, the master terminal 206 can receive hard copy requests via the first set of requests and soft copy requests via the second set of requests. The master terminal 206 can communicate the hard copy requests and the soft copy requests to the lottery authority 102 such that the requests are treated as hard copy requests. If approved or confirmed by the lottery authority 102, the lottery authority will issue responses to each request, wherein the response is a lottery ticket or lottery ticket information (e.g., a number for a draw game, for example). The master terminal 206 can receive the response for each request from the lottery authority 102 and identify which responses correspond for each request. Upon identifying the corresponding response for each request, the master terminal 206 can indicate which requests were for a hard copy or a soft copy. Thus, the master terminal 206 can then issue a hard copy of the response for each request in the first set of requests and/or a soft copy of the response for each request in the second set of requests.

Figure 4:
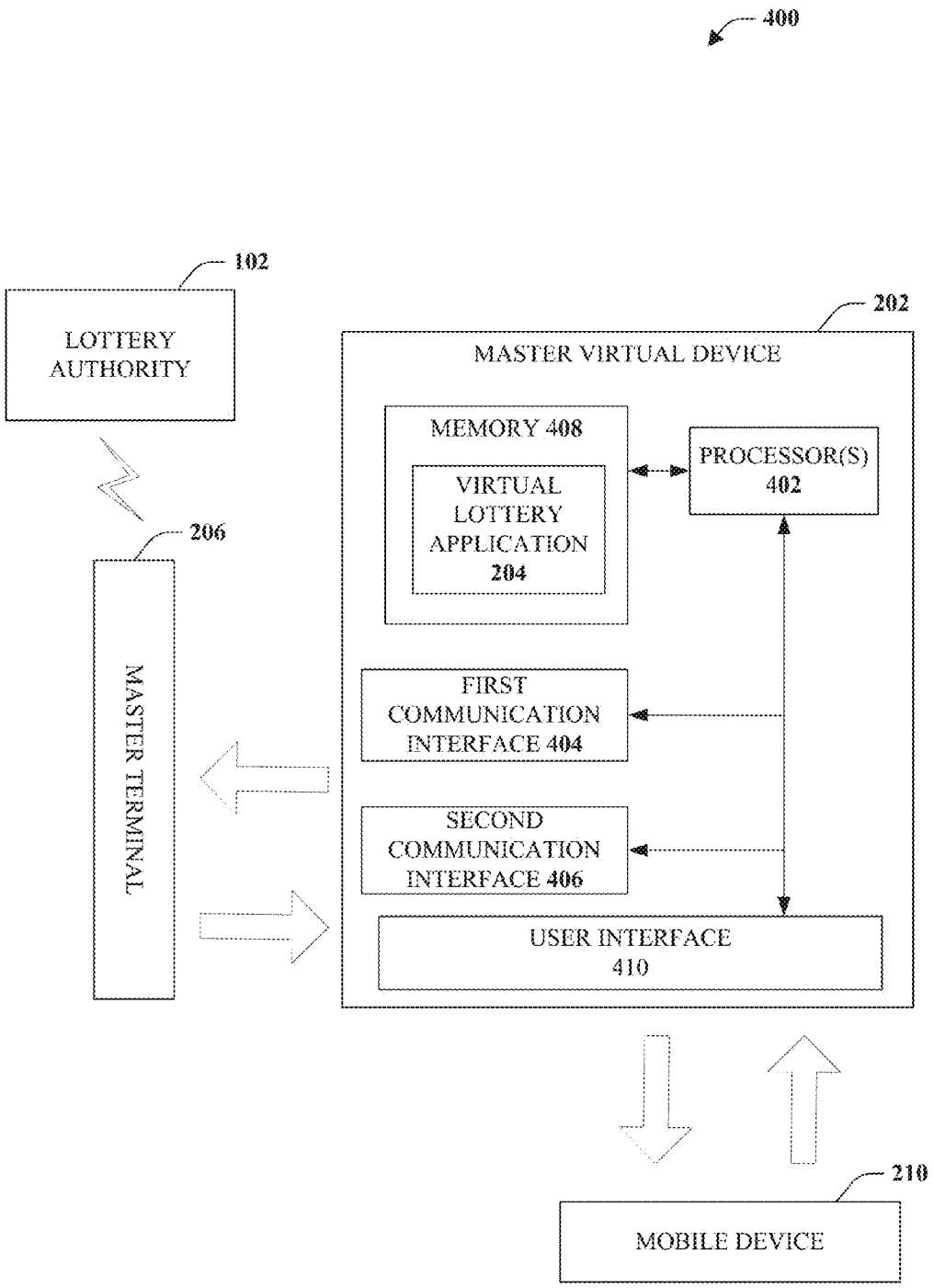
FIG. 4 is an illustration of an embodiment of a system that is configured to sell soft copies of lottery tickets with a master virtual device coupled to a master terminal that communicates with a lottery authority.

Turning to FIG. 4, a system 400 is illustrated utilizing the master virtual device 202 and the virtual lottery application 204 to process a second set of requests for a soft copy of a lottery ticket via the master terminal 206 from the lottery authority 102. Master virtual device 202 includes one or more processor(s) 402 configured to execute computer-executable instructions such as instructions composing virtual lottery application 204. Such computer-executable instructions can be stored on one or more computer-readable media including a non-transitory, computer-readable storage medium such as memory 408 of master virtual device 202.

Master virtual device 202 includes a first communication interface 404 and a second communication interface 406. As shown in FIG. 4, first communication interface 404 can enable electronic communications between the master virtual device 202 and the master terminal 206. It is to be appreciated that the first communication interface 404 can be a wired or wireless interface including, but not limited, a LAN cable, an Ethernet cable, a USB interface, a serial interface, a WiFi interface, a short-range RF interface (Bluetooth), an infrared interface, a near-field communication (NFC) interface, etc. Second communication interface 406 can enable electronic communications between one or more mobile devices 210 and the master virtual device 202. As such, second communication interface 406 can be a WiFi interface, an Ethernet interface, a fiber optic interface, a cellular radio interface, a satellite interface, an interface for the Internet, etc. While shown separate in FIG. 4, first communication interface 404 and second communication interface 406 can be a single interface or an interface capable of simultaneous communication over multiple connections.

Master virtual device 202 can further include a merchant interface 410 that comprises various elements to obtain merchant input and to convey merchant output. For instance, merchant interface 410 can comprise a touch display which operates as both an input device and an output device. In addition, merchant interface 410 can also include various buttons, switches, keys. etc. by which a merchant can input information to master virtual device 202, and other displays, LED indicators, etc. by which other information can be output to the merchant.

In accordance with an embodiment, master virtual device 202 is a computing device, which can be hosted at a physical location or site of the master terminal 206. However, it is to be appreciated that the master virtual device 202 can be other portable form-factors such as a laptop computer, a convertible laptop, a cell phone, a PDA, a pocket computing device, a watch computing device, or the like. Moreover, it is to be appreciated that the functionality described herein with respect to the master virtual device 202 can be performed by a desktop computer, or other larger, less portable computing device. That is, virtual lottery application 204 can be installed and executed on substantially any computing device provided that such a computing device can communicate with the master terminal 206 as described above with regard to FIGS. 1-3.

It is to be appreciated that the master virtual device 202 and/or the virtual lottery application 204 can be a network or a portion of a network, wherein the network is at least one of a website, a server, a computer, a cloud-service, a processor and memory, or a computing device connected to the Internet and connected to the master terminal 206. In general, the network can be coupled to one or more devices via wired or wireless connectivity in which data communications are enabled between the network and at least one of a second network, a subnetwork of the network, or a combination thereof. It is to be appreciated that any suitable number of networks can be used with the subject innovation and data communication on networks can be selected by one of sound engineering judgment and/or one skilled in the art.

Figure 5:
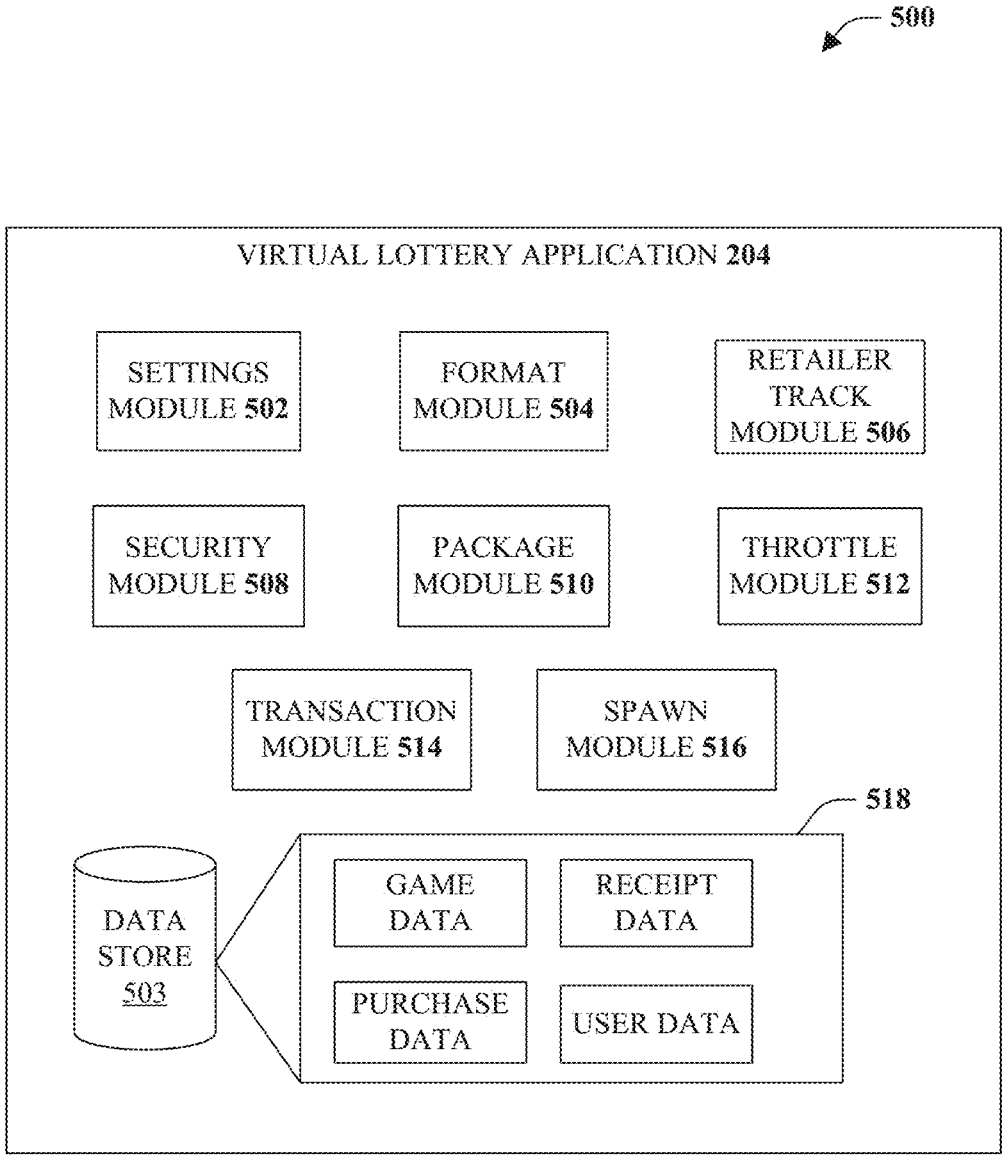
FIG. 5 is a block diagram of an exemplary, non-limiting virtual lottery application according to one or more aspects.

FIG. 5 illustrates a block diagram of an exemplary, non-limiting embodiment of the virtual lottery application 204 according to one or more aspects. Virtual lottery application 204 comprises computer-executable instructions and computer-readable data stored on memory 408 of the master virtual device 202. The computer-executable instructions of virtual lottery application 204 are executable by processor 402 of master virtual device 202.

As shown in FIG. 5, the virtual lottery application 204 can include one or more modules (e.g., setting module 502, format module 504, retailer track module 506, security module 508, package module 510, throttle module 512, transaction module 514, spawn module 516, among others) and data 518 stored on a data store 503 that stores data 518 (e.g., lottery game data, receipt data, purchase data, user data, among others). The one or more modules can include computer-executable instructions implementing various features, processes, operations, etc. of the virtual lottery application 204.

As shown in FIG. 5, the virtual lottery application 204 includes various data 518. Data 518 includes game data (e.g., lottery ticket information, lottery ticket layout of information, type of a lottery game, input for a lottery game, cost to play the lottery game, date and time of the lottery game, date and time of ticket or entry purchase, and the like), receipt data (e.g., cost, user information, merchant information, account information, data representative of confirmation from the lottery authority 102, time of purchase, date of purchase, among others), purchase data (e.g., price, merchant or seller that received payment, account information, user account information, device that lottery ticket was purchased from (e.g., master terminal, slave terminal, virtual master device, etc.) among others), user data (e.g., physical address, Internet Protocol (IP) address, account information, account credentials, history of purchases, game play history, number selection history, among others), data utilized by the virtual lottery application 204, and the like.

The settings module 502 can be configured to provide data communications related to configuring a parameter related to the master virtual device 202 and/or the virtual lottery application 204. In terms of the master virtual device 202, the settings component 502 can be used to configure communications settings between the master virtual device 202 and the master terminal 206. It is to be appreciated that the communication settings between the master virtual device 202 and the master terminal 206 can be replicated to the communication settings between the master terminal 206 and the slave terminal 208. In another example, the settings module 502 can be utilized to configure communication settings between the master virtual device 202 and one or more mobile devices 210. For example, the settings module 502 can allow definition of the following parameters: number of mobile devices for connectivity to the master virtual device 202; credentials required for connectivity; security protocol definitions; mobile device requirements; data representative of tracking a merchant that makes a sale of a hard copy of the lottery ticket; data representative of tracking a merchant that makes a sale of a soft copy of the lottery ticket; definition of games available for purchase; type of payment accepted; time or date deadline for purchase of a lottery ticket for the lottery game; authentication of user to purchase a lottery ticket; notifications related to the sale of the lottery ticket; alerts related to an activity of selling the lottery tickets; and the like. Settings module 502 can further provide administration functions, configuration of virtual lottery application 204, or the like.

The settings module 502 can be further configured to provide data communications related to configuring a parameter related to the master terminal 206, the slave terminal 208, and/or the lottery authority 102. As discussed above, the virtual lottery application 204 can be hosted by the master terminal 206, the slave terminal 208, and/or the lottery authority 102. The settings module 502 can allow definition of at least one of the following: format of communication of the first set of requests and the second set of requests to the lottery authority (e.g., batch communication, serial communication, etc.); number of soft copy sale requests received within a duration of time; credentials required for connectivity; security protocol definitions; mobile device requirements; data representative of tracking a merchant that makes a sale of a hard copy of the lottery ticket; data representative of tracking a merchant that makes a sale of a soft copy of the lottery ticket; definition of games available for purchase; type of payment accepted; time or date deadline for purchase of a lottery ticket for the lottery game; authentication of user to purchase a lottery ticket; notifications related to the sale of the lottery ticket; and alerts related to an activity of selling the lottery tickets.

The format module 504 can be configured to provide formatting of data received for a soft copy of a lottery ticket (e.g., from a mobile device) from a first format to a second format, wherein the second format is compatible for handling by the master terminal 206. It is to be appreciated that the format module 504 can be configured to provide formatting of data between a request of a soft copy of a lottery ticket to the master terminal 206 in one or more formats. The format module 504 can create a data package from data associated with a request for a purchase of a soft copy of a lottery ticket in which the data package can be handled and processed (e.g., compatible) with the master terminal 206, and in turn, the lottery authority 102. In particular, the format module 504 can replicate a format of data communicated from the slave terminal 208 to the master terminal 206 so that a second set of requests (from the master virtual device 202) for sales of soft copies of lottery tickets are handled and processed (by the master terminal 206 and lottery authority 102) just as a first set of requests (from the master terminal 206 or slave terminal 208) of sales for hard copies of lottery tickets.

A retailer track module 506 can be configured to utilize one or more data portions (e.g., bit of data, bits of data, string of data, etc.) to track and record a number of total sales of lottery tickets which include soft copies and hard copies of lottery tickets. In particular, a first data portion can be utilized to represent a number of hard copy sales for a lottery ticket of a draw game and a second data portion can be utilized to represent a number of soft copy sales for a lottery ticket of a draw game, wherein each of the first data portion and the second data portion include data representative of a merchant responsible for the hard copy sales or the soft copy sales. For instance, each merchant can include an indicia that is used to designate that such merchant is responsible for a hard copy sale and/or a soft copy sale since the sale was from the merchant's device (e.g., virtual lottery application, master terminal, slave terminal, master virtual device, or a combination thereof). Thus, if there are three (3) merchants, each merchant can be assigned a respective indicia in order to designate and track who is responsible for which lottery sales since the lottery sales can be embedded with an indicia when the sale is requested or completed. In another instance, a first indicia can be used for a hard copy sale by a merchant and a second indicia can be used for a soft copy sale by the merchant. This dual indicia tracking can provide a more granular evaluation of sale data as it shows the amount of hard copy sales and soft copy sales for each merchant. The retailer track module 506 can be leveraged to provide monetary compensation to a merchant based on the tracked number of sales which can include hard copy sales and soft copy sales. Thus, the retailer track module 506 can communicate tracked sales data to the lottery authority 102 or another device in order to provide commission payouts.

It is to be appreciated that in an embodiment, the merchant that is responsible for a sale can be determined by the fact of which merchant is managing the master terminal that is in communication with the lottery authority 102 for the request for a lottery ticket (e.g., hard copy or soft copy). Yet, it is to be appreciated that the responsible merchant for compensation based on the tracked number of sales can be defined by various ways. For example, an owner or lessee of the master virtual device 202 can be defined as a merchant responsible for a sale of a soft copy of a lottery ticket and a merchant of a site that houses the master terminal 206 can be defined as a merchant responsible for a sale of a hard copy of a lottery ticket. In still another embodiment, the owner of a component that receives of a request for a purchase of a lottery ticket can be designated as the merchant responsible for a sale. In still another agreement, the merchant responsible for sale of the lottery ticket can be determined by a contract or by who owns a lease of devices or components (e.g., virtual lottery application, master terminal, slave terminal, master virtual device, etc.).

A security module 508 can be configured to provide security protocols to data communications utilized by the virtual lottery application 204. For instance, one or more security protocols can be employed for data communications between the master virtual device 202 and one or more mobile devices 210. For example, the following security techniques can be employed: human interactive proof (HIP); user name and password; security questions; verification of imagery from a user; biometric data from a user; and cryptographic algorithm and a key. In another instance, one or more security protocols can be employed for data communications between the master virtual device 202 and the master terminal 206. The one or more security protocols to be employed for data communications between the master virtual device 202 and the master terminal 206 can be replications of data communications between the master terminal 206 and the slave terminal 208, for example.

Security module 508 can further afford preventative security techniques to combat online cyber-attacks. The security module 508 can be configured to identify a potential threat or unauthorized data received. In particular, the security module 508 can include a definition related to data patterns or IP addresses that can indicate a potential threat. Based on the detection from the definition, the security module 508 can employ a preventative measure, wherein the preventative measure can be, but is not limited to, terminating a connection with a mobile device, terminating a connection with a master terminal, terminating a connection with a slave terminal, terminating a connection with a lottery authority, communicating a notification (e.g., to a master terminal, a slave terminal, a lottery authority, etc.), collecting information related to a user or a mobile device, communicating a notification to a legal authority, among others. It is to be appreciated that the security module 508 can detect potential cyber threats such as, but not limited to, data packet sniffing, distributed denial-of-service (DOS) attacks, among others.

A package module 510 can be configured to create a data package from data received from the mobile device 210 and/or the master terminal 206, wherein such data package includes data representative of a request, from a mobile device, for a purchase of a lottery ticket for a lottery game managed by the lottery authority 102. The request can include data such as, but not limited to, a quantity of lottery tickets, a type of lottery ticket, a number selection (e.g., generated by the lottery authority 102 or user selected), and merchant identification data (e.g., data bit representing which merchant is responsible for a sale of the lottery ticket). The data package created by the package module 510 can be formatted by the format module 504 and communicated to the master terminal 206 via the first communication interface 404 for deliver to the lottery authority 102.

A throttle module 512 can be configured to manage a number of mobile devices 210 connected to the master virtual device 202 and/or the virtual lottery application 204. For instance, based on a time or date of a draw game deadline, the throttle module 512 can increase or decrease the number of mobile device 210 that can be connected to the master virtual device 202 to process a sale of a soft copy of a lottery ticket for the draw game. The throttle module 512 can be utilized to ensure that a request for a soft copy of a lottery ticket is processed and satisfied by the lottery authority 102 and not denied due to the request being received after the draw game deadline. Moreover, the throttle module 512 can be configured to provide a first throttle technique to the first set of requests for the master terminal 206 or the second set of requests for the virtual lottery application 204 or the master virtual device 202. It is to be appreciated that the throttle module 512 can be configured to employ one or more throttle techniques. Moreover, it is to be appreciated that the throttle module 512 can be configured to employ a throttle technique for each of the master terminal, the slave terminal 208, the master virtual device 202, a number of hard copy sale requests, a number of soft copy sale requests, or a combination thereof.

The throttle module 512 can communicate the second set of requests for a soft copy of a lottery ticket for the draw game in at least one of a batch mode (e.g., communicate a set number of requests at a time to the master terminal 206), a one-by-one (e.g., communicate each request from a mobile device to the master terminal 206 as it is processed by the master virtual device 202), or a timed-base release (e.g., a periodic communication of requests from mobile devices 210 to the master terminal 206 such as communicating an amount of requests every X seconds, where X is a positive integer). It is to be appreciated that the throttle module 512 can replicate a throttling technique used by the master terminal 206 for communicating the first set of requests for a hard copy of a lottery ticket to the lottery authority 102. In another embodiment, the throttling technique used by the master terminal 206 for communicating the first set of requests for a hard copy of a lottery ticket to the lottery authority 102 can be a baseline for establishing a throttle for the second set of requests for a soft copy of a lottery ticket or a number of mobile devices 210 that can connect to the master virtual device 202. For instance, a master terminal 206 can include a maximum number of fifty (50) requests for hard copies to communicate to a lottery authority and the throttle module 512 can utilize a percentage of the maximum number for its maximum. In another embodiment, the throttle module 512 can be configured to dynamically adjust the maximum amount for each of the first set of requests or the second set of requests based on the amount received and/or a pre-defined deadline of a lottery drawing. In still another embodiment, the throttle module 512 can receive a throttle parameter (e.g., a parameter that defines a type of throttling, an amount of throttling, which data request to throttle and when to throttle, etc.) from the lottery authority 102.

A transaction module 514 can be utilized to process a purchase between a user controlling the mobile device and the master virtual device 202 in which the purchase is an exchange of money for a soft copy of a lottery ticket for a lottery game controlled by the lottery authority 102. The transaction module 514 can provide data communications between the user of the mobile device and the virtual lottery application 204 to complete a sale of the soft copy of the lottery ticket. For instance, the transaction module 514 can handle data communications that include, but are not limited to, a third-party account transactions, electronic fund transfers, bank transfers, authentication of accounts, username or password authentication, and the like.

A spawn module 516 can be configured to generate an additional or multiple virtual lottery applications in order to handle an increased amount of requests for a soft copy of a lottery ticket. For example, a threshold can be defined or pre-defined in which the threshold relates to a number of the second set of requests that are received from mobile devices for soft copy sales. The threshold can, in another example, relate to a number of the second set of requests that are communicated to the lottery authority. In either example, the threshold can be used to create an additional virtual lottery application to handle an overflow of the second set of requests. In another embodiment, an additional master virtual device can be idle and activated in order to process the second set of requests if the threshold is met, approached, or exceeded.

For instance, the throttle module 512 can include a maximum number of requests designated for a relationship (e.g., communications between the master virtual device 202, virtual lottery application 204, and the master terminal 208). If the number of requests is over the maximum for the relationship (e.g., an overflow of requests), the spawn module 516 can generate an additional virtual lottery application to handle the overflow of requests for such relationship. In an example of such instance, the additional virtual lottery application 204 can utilized as a queue to hold the overflow of requests until requests for the relationship are below the maximum number of requests and once below can be communicated and handled by the relationship. In another example of such instance, the additional virtual lottery application 204 can communicate the overflow of requests to a second relationship (e.g., communications between the additional virtual lottery application and an additional master terminal 212) if the additional master terminal 212 has bandwidth for handling the overflow requests. The additional master terminal 212 can be on the site of the master terminal 206 or on another site or another physical location compared to the master terminal 206. If the additional master terminal 212 is on another site compared to the master terminal 206, such data can be recorded and tracked (e.g., via a portion of data, a data bit, data bits, a string of data, etc.) so as to be used to track a number of sales of a soft copy of a lottery ticket. Thus, these additional relationships between sites and master terminals can include a distribution for compensation so as to foster relationships between merchants.

Further, an additional master terminal 212 from another site can be utilized with the virtual lottery application 204 as a second relationship and each relationship (the relationship and the second relationship) can include a payment percentage for compensation. In another embodiment, the second relationship can be utilized not in case of an overflow of requests but in the manner to alleviate costs of owning or leasing the virtual lottery application 204. In other words, a first merchant having a system (e.g., master virtual device and/or virtual lottery application) can allow a second merchant or entity to communicate soft copy sales of lottery tickets to the first merchant's system for processing, wherein the percentage of the sale for the soft copy sales can be divided between the first merchant and the second merchant based on the use of the first merchant's system.

Although a single data store 503 is illustrated, any suitable number of data stores can be used with the system 500. The number of data stores and the organization where the data is stored there on can be selected with sound engineering judgment and/or by one skilled in the art without departing from the scope of the subject innovation.

It is to be appreciated that any component or module from the virtual lottery application 204 can be a stand-alone component/module, a sub-component, a sub-module, an integrated component with another component, an integrated module within another module, a system, a portion of a system described herein (e.g., FIGS. 1-4, 6-7), and/or a combination thereof. Thus, the functionality described for the virtual lottery application 204 can be performed by any number of the components or modules discussed.

Figure 6:
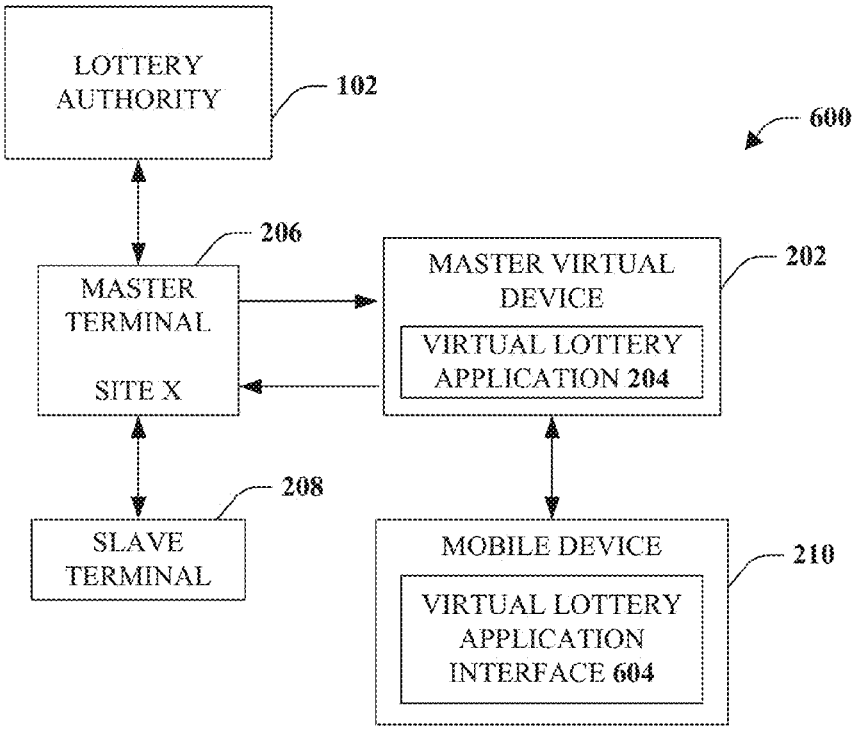
FIG. 6 is an illustration of an embodiment of a system that facilitates distributing soft copies of lottery tickets with a virtual lottery application that couples to a master terminal.

FIG. 6 is illustrates a system 600 that facilitates distributing soft copies of lottery tickets with a virtual lottery application that couples to a master terminal. The system 600 include the master virtual device 202 with the virtual lottery application 204. In an embodiment, each mobile device 210 can utilize a virtual lottery application 604 that is installed an executed thereon. Such install and execution can facilitate data communications between the mobile device 210 and the master virtual device 202 and/or the virtual lottery application 204. Moreover, it is to be appreciated that a portion or sub-portion of modules described herein for the virtual lottery application 204 can be hosted by at least one of the master virtual device 202, the mobile device 210, a server, a data base, a cloud service, or a combination thereof.

Figure 7:
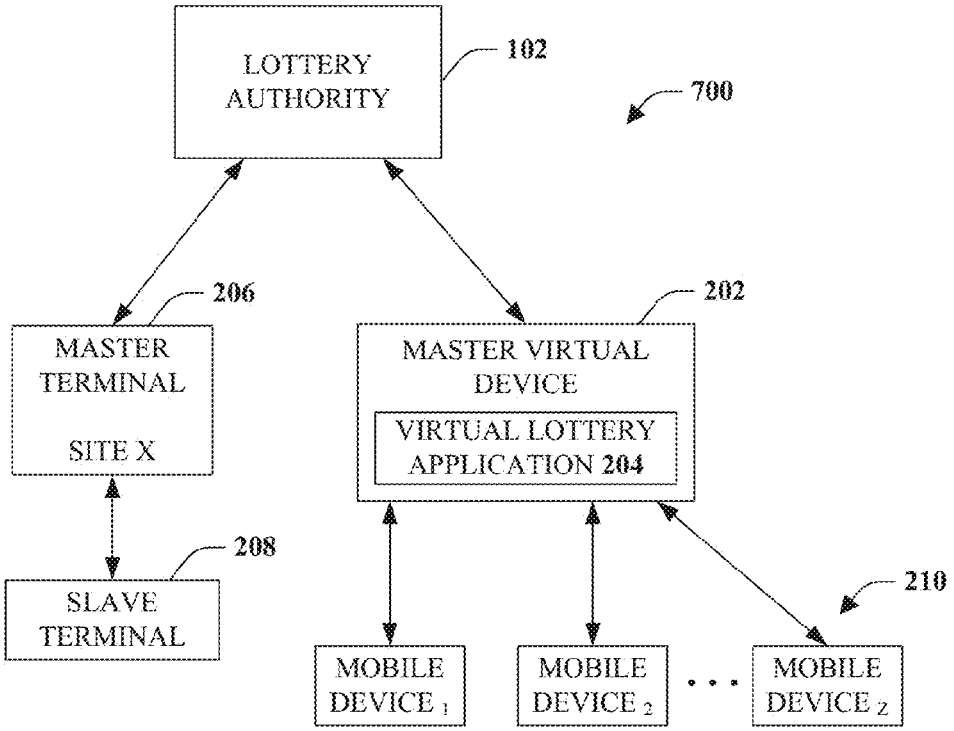
FIG. 7 is an illustration of an embodiment of a system that is configured to sell soft copies of lottery tickets directly from a lottery authority and to a player.

FIG. 7 is an illustration of a system 700 that is configured to sell soft copies of lottery tickets directly from a lottery authority and to a player. The system 700 illustrates a master virtual device 202 that is in electronic communication with the lottery authority 102. In such an embodiment, the master virtual device 202 is configured to replicate communications between the master terminal 206 and the lottery authority 102. Thus, the master virtual device 202 can communicate requests for a soft copy of a lottery ticket to the lottery authority 102 just as the master terminal 206 communicates requests for a hard copy of a lottery ticket to the lottery authority 102. The master virtual device 202 can utilize at least one of a data format, a security key, a data encryption, a data decryption, the first data connection, among others. In such an embodiment illustrated in FIG. 7, the first set of request for a hard copy of a lottery ticket are communicated by the master terminal 206 to the lottery authority via a first data connection and the second set of requests for a soft copy of a lottery ticket are communicated by the master virtual device 202 to the lottery authority 102 via the first data connection. Thus, this embodiment enables the master virtual device 202 to directly communicate with the lottery authority 102 and can leverage protocols of the lottery authority 102.

The aforementioned systems, modules, components, (e.g., master virtual device 202, virtual lottery application 204, among others), and the like have been described with respect to interaction between several components, modules, and/or elements. It should be appreciated that such devices and elements can include those elements or sub-elements specified therein, some of the specified elements or sub-elements, and/or additional elements. Further yet, one or more elements and/or sub-elements may be combined into a single component or module to provide aggregate functionality. The elements may also interact with one or more other elements not specifically described herein.

Figure 8:
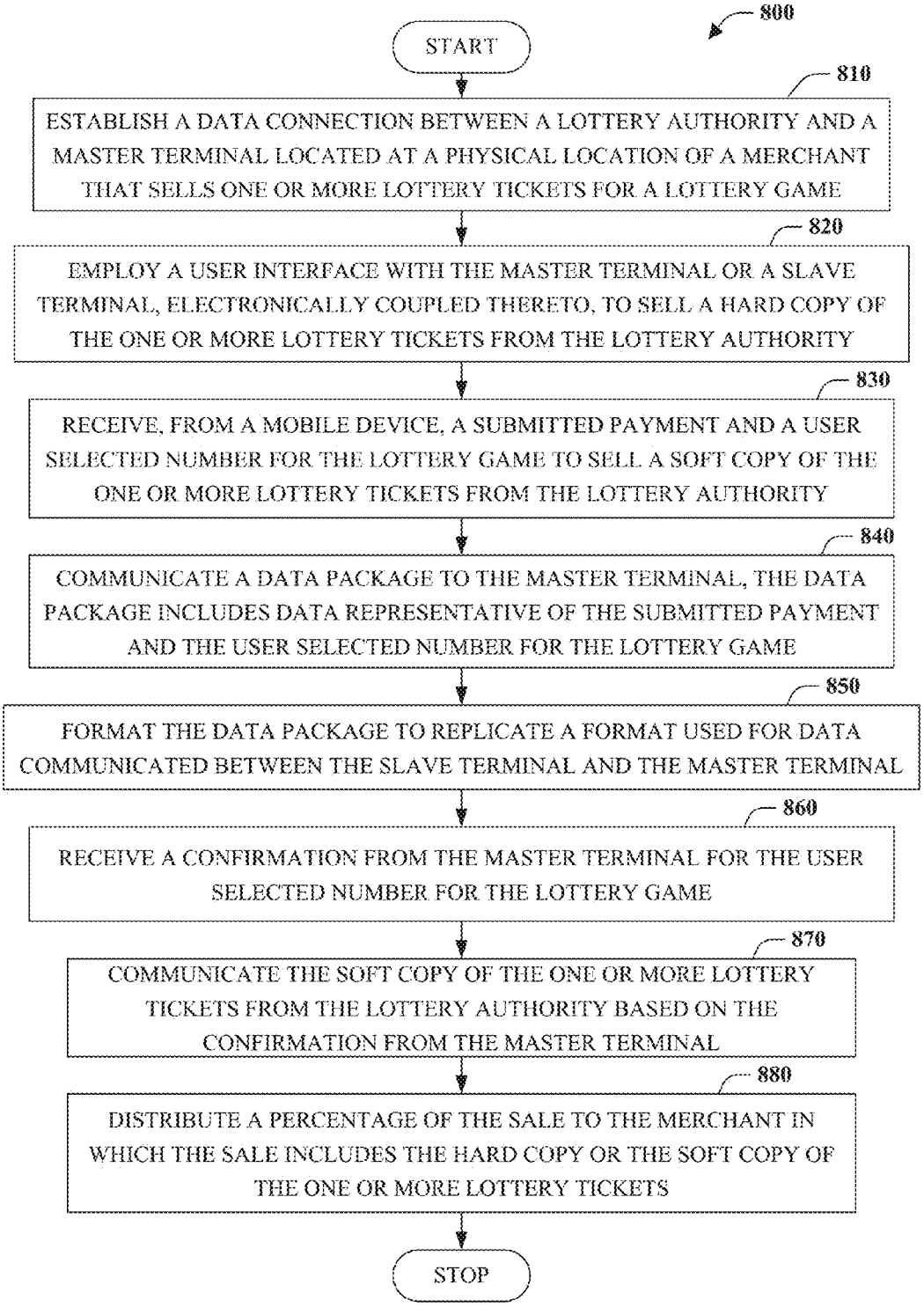
FIG. 8 is an illustration of a flow chart of an embodiment of a method establishing connectivity with a master terminal to sell one or more soft copies of lottery tickets from a lottery authority.
Figure 9:
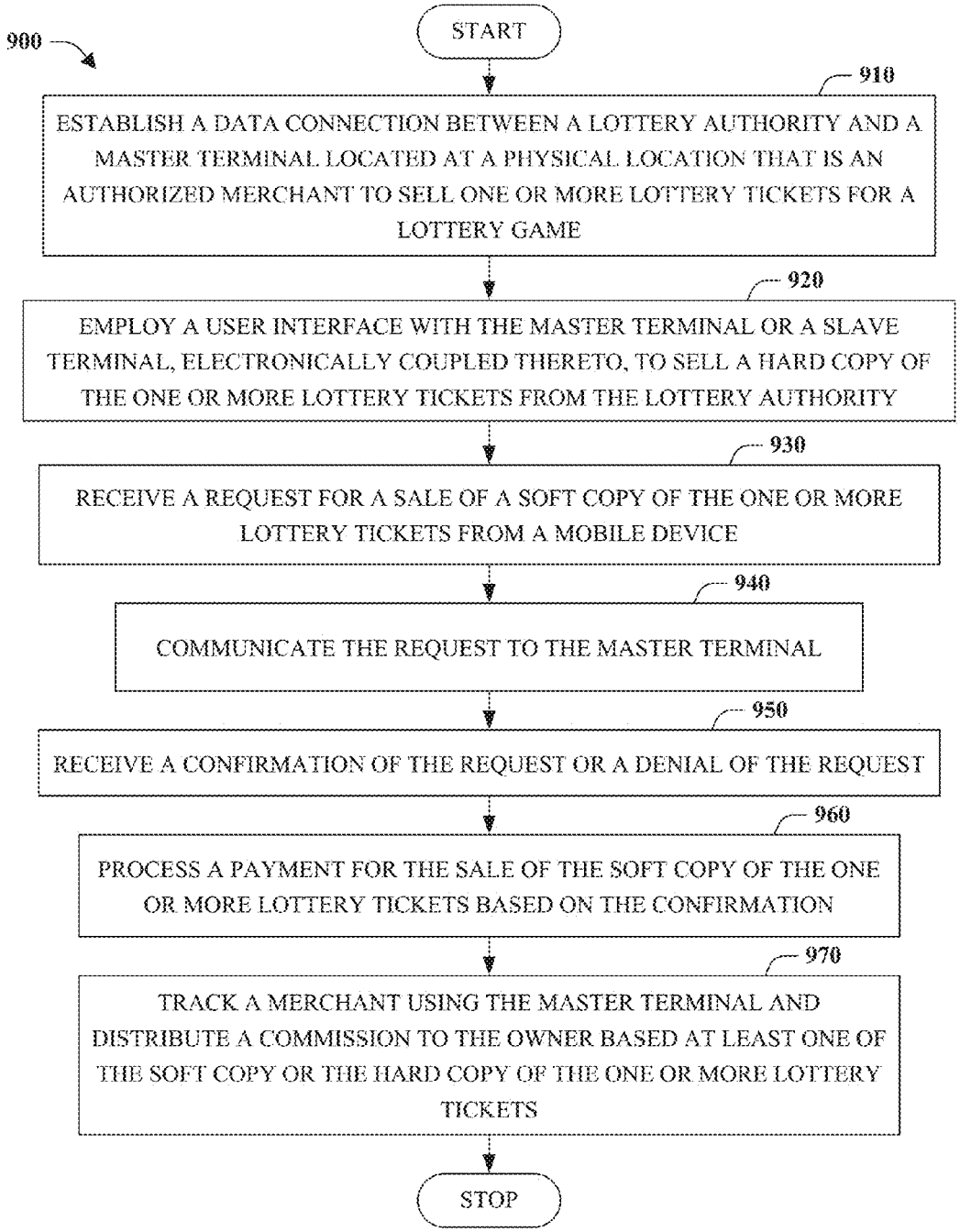
FIG. 9 is an illustration of a flow chart of an embodiment of a method for tracking sales of soft copies of lottery tickets based on which physical location receives a request to purchase the lottery ticket.
Figure 10:
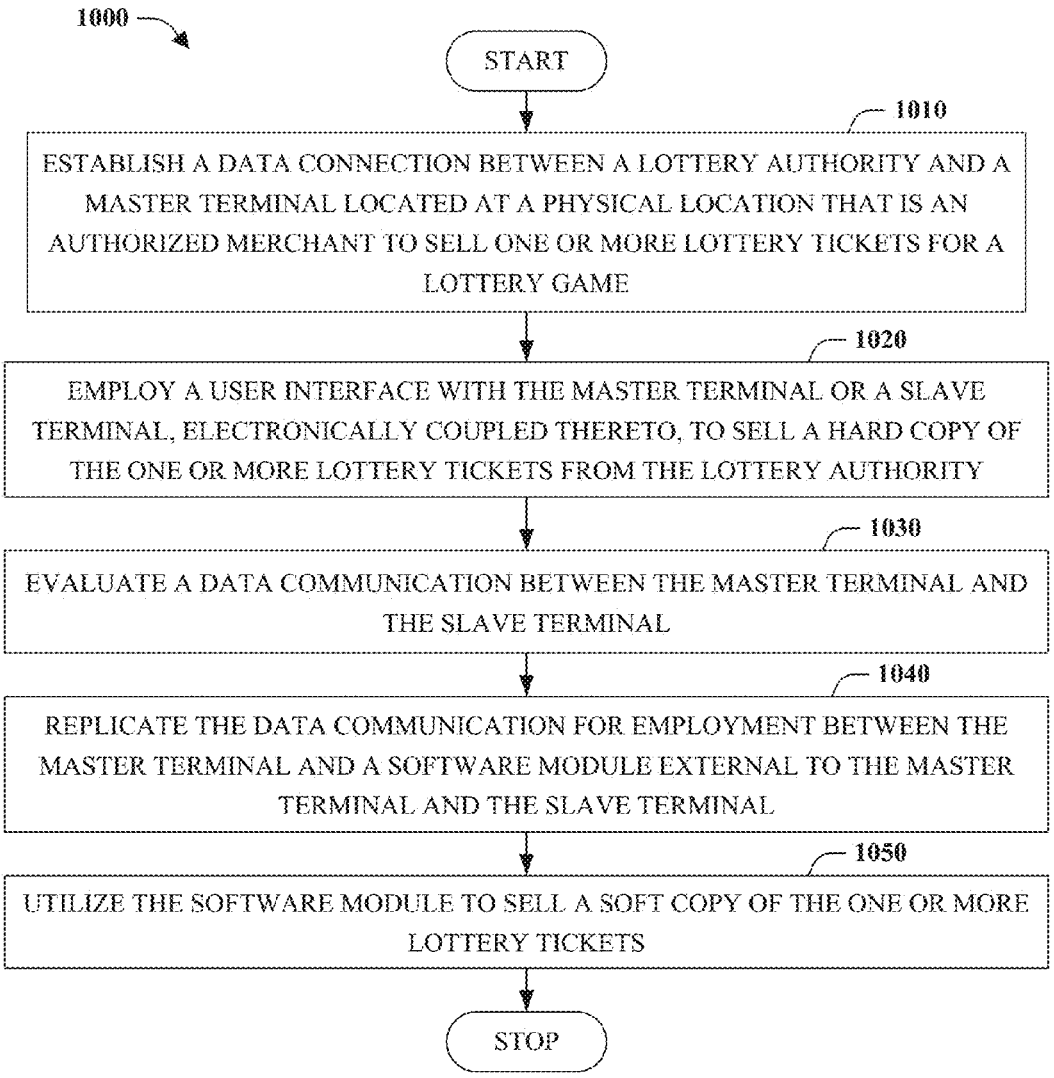
FIG. 10 is an illustration of a flow chart of an embodiment of a method for utilizing a software module to process an electronic transaction for a soft copy of a lottery ticket through a master terminal in electronic communication with a lottery authority.

In view of the exemplary devices and elements described supra, methodologies that may be implemented in accordance with the disclosed subject matter will be better appreciated with reference to the flow charts of FIGS. 8-10. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described hereinafter.

FIG. 8 illustrates a method 800 that establishes connectivity with a master terminal to sell one or more soft copies of lottery tickets from a lottery authority.

At reference numeral 810, a data connection can be established between a lottery authority and a master terminal located at a physical location of a merchant that sells one or more lottery tickets for a lottery game. At reference numeral 820, a user interface can be employed with the master terminal or a slave terminal, electronically coupled thereto, to sell a hard copy of the one or more lottery tickets from the lottery authority. At reference numeral 830, a submitted payment and a user selected number for the lottery game can be received from a mobile device to sell a soft copy of the one or more lottery tickets from the lottery authority.

At reference numeral 840, a data package can be communicated to the master terminal, the data package includes data representative of the submitted payment and the user selected number for the lottery game. At reference numeral 850, the data package can be formatted to replicate a format used for data communicated between the slave terminal and the master terminal. At reference numeral 860, a confirmation can be received from the master terminal for the user selected number for the lottery game.

At reference numeral 870, the soft copy of the one or more lottery tickets can be communicated from the lottery authority based on the confirmation from the master terminal. At reference numeral 880, a percentage of the sale can be distributed to the merchant in which the sale includes the hard copy or the soft copy of the one or more lottery tickets.

FIG. 9 illustrates a method 900 that tracks sales of soft copies of lottery tickets based on which physical location receives a request to purchase the lottery ticket. At reference numeral 910, a data connection can be established between a lottery authority and a master terminal located at a physical location of a merchant that sells one or more lottery tickets for a lottery game. At reference numeral 920, a user interface can be employed with the master terminal or a slave terminal, electronically coupled thereto, to sell a hard copy of the one or more lottery tickets from the lottery authority.

At reference numeral 930, a request for a sale of a soft copy of the one or more lottery tickets can be received from a mobile device. At reference numeral 940, the request can be communicated to the master terminal. At reference numeral 950, a confirmation of the request or a denial of the request can be received. At reference numeral 960, a payment for the sale of the soft copy of the one or more lottery tickets can be processed based on the confirmation. At reference numeral 970, a merchant using the master terminal can be tracked and a commission can be distributed to the owner based at least one of the soft copy or the hard copy of the one or more lottery tickets.

FIG. 10 illustrates a method 1000 that utilizes a software module to process an electronic transaction for a soft copy of a lottery ticket through a master terminal in electronic communication with a lottery authority. At reference numeral 1010, a data connection can be established between a lottery authority and a master terminal located at a physical location of a merchant that sells one or more lottery tickets for a lottery game. At reference numeral 1020, a user interface can be employed with the master terminal or a slave terminal, electronically coupled thereto, to sell a hard copy of the one or more lottery tickets from the lottery authority.

At reference numeral 1030, a data communication between the master terminal and the slave terminal can be evaluated. At reference numeral 1040, the data communication can be replicated for employment between the master terminal and a software module external to the master terminal and the slave terminal. At reference numeral 1050, the software module can be utilized to sell a soft copy of the one or more lottery tickets.

As used herein, the terms "component," "module," and "system," as well as forms thereof are intended to refer to a computer-related entity, either hardware, a combination of hardware and software, software, or software in execution. For example, a component or module may be, but is not limited to being, a process running on a processor, a processor, an object, an instance, an executable, a thread of execution, a program, and/or a computer. By way of illustration, both an application running on a computer and the computer can be a component or a module. One or more components may reside within a process and/or thread of execution and a component may be localized on one computer and/or distributed between two or more computers. One or more modules may reside within a process and/or thread of execution and a module may be localized on one computer and/or distributed between two or more computers. It is to be appreciated that one or more processors can be utilized with the subject innovation.

It is to be appreciated that an "application" can include one or more modules that perform one or more functionalities via instructions stored on a memory executed by a processor. Moreover, although a module and functionality may be described as a single module, it is to be appreciated that modules and respective functionalities can be combined into two or more modules. Additionally, one or more applications can be provided to include the one or more modules described herein. For example, the virtual lottery application 202 can be comprised of one or more applications that perform the functionalities described herein, wherein the one or more applications include one or more of the modules described herein.

It is to be appreciated that the "application" (here the virtual lottery application 204) can be hosted in a cloud, on a mobile device, on a server, on a computing device (e.g., computer, master virtual device 202, master terminal, slave terminal, and the like), and/or a combination thereof. Moreover, although a single processor and/or memory is illustrated, it is to be appreciated that one or more processors and/or one or more memory can be employed with the subject innovation.

The word "exemplary" or various forms thereof are used herein to mean serving as an example, instance, or illustration. Any aspect or design described herein as "exemplary" is not necessarily to be construed as preferred or advantageous over other aspects or designs. Furthermore, examples are provided solely for purposes of clarity and understanding and are not meant to limit or restrict the claimed subject matter or relevant portions of this disclosure in any manner. It is to be appreciated a myriad of additional or alternate examples of varying scope could have been presented, but have been omitted for purposes of brevity.

Furthermore, to the extent that the terms "includes," "contains." "has," "having" or variations in form thereof are used in either the detailed description or the claims, such terms are intended to be inclusive in a manner similar to the term "comprising" as "comprising" is interpreted when employed as a transitional word in a claim.

Figure 11:
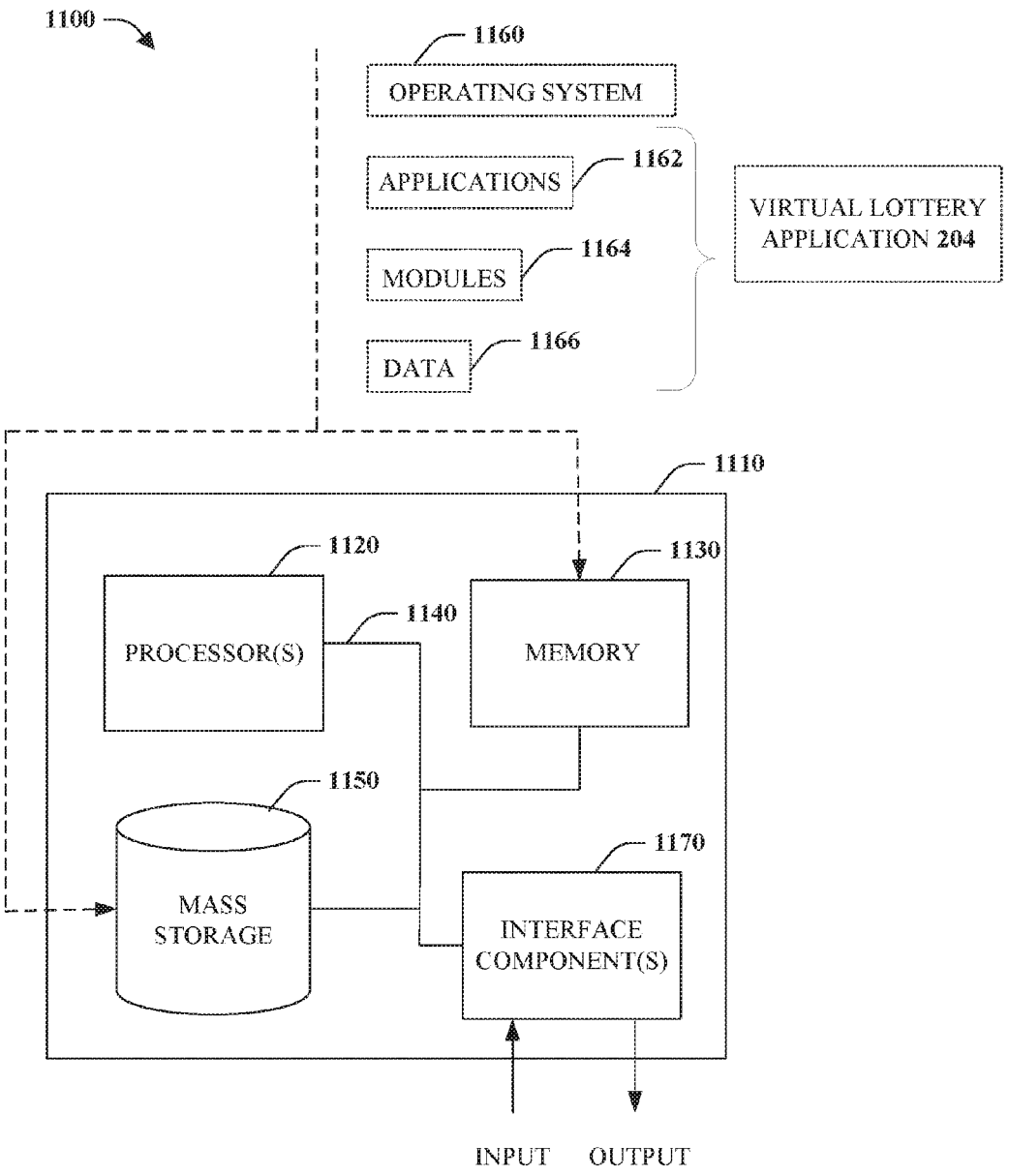
FIG. 11 is a schematic block diagram illustrating a suitable operating environment for aspects of the subject disclosure.

In order to provide a context for the claimed subject matter, FIG. 11 as well as the following discussion are intended to provide a brief, general description of a suitable environment in which various aspects of the subject matter can be implemented. The suitable environment, however, is only an example and is not intended to suggest any limitation as to scope of use or functionality.

While the above disclosed system and methods can be described in the general context of computer-executable instructions of a program that runs on one or more computers, those skilled in the art will recognize that aspects can also be implemented in combination with other program modules or the like. Generally, program modules include routines, programs, components, data structures, among other things that perform particular tasks and/or implement particular abstract data types. Moreover, those skilled in the art will appreciate that the above systems and methods can be practiced with various computer system configurations, including single-processor, multi-processor or multi-core processor computer systems, mini-computing devices, mainframe computers, as well as personal computers, hand-held computing devices (e.g., personal digital assistant (PDA), portable gaming device, smartphone, tablet, Wi-Fi device, laptop, phone, among others), microprocessor-based or programmable consumer or industrial electronics, and the like. Aspects can also be practiced in distributed computing environments where tasks are performed by remote processing devices that are linked through a communications network. However, some, if not all aspects of the claimed subject matter can be practiced on stand-alone computers. In a distributed computing environment, program modules may be located in one or both of local and remote memory storage devices.

With reference to FIG. 11, illustrated is an example general-purpose computer 1110 or computing device (e.g., desktop, laptop, server, hand-held, programmable consumer or industrial electronics, set-top box, game system . . . ). The computer 1110 includes one or more processor(s) 1120, memory 1130, system bus 1140, mass storage 1150, and one or more interface components 1170. The system bus 1140 communicatively couples at least the above system components. However, it is to be appreciated that in its simplest form the computer 1110 can include one or more processors 1120 coupled to memory 1130 that execute various computer executable actions, instructions, and or components stored in memory 1130.

The processor(s) 1120 can be implemented with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any processor, controller, microcontroller, or state machine. The processor(s) 1120 may also be implemented as a combination of computing devices, for example a combination of a DSP and a microprocessor, a plurality of microprocessors, multi-core processors, one or more microprocessors in conjunction with a DSP core, or any other such configuration.

The computer 1110 can include or otherwise interact with a variety of computer-readable media to facilitate control of the computer 1110 to implement one or more aspects of the claimed subject matter. The computer-readable media can be any available media that can be accessed by the computer 1110 and includes volatile and nonvolatile media, and removable and non-removable media. By way of example, and not limitation, computer-readable media may comprise computer storage media and communication media.

Computer storage media includes volatile and nonvolatile, removable and non-removable media implemented in any method or technology for storage of information such as computer-readable instructions, data structures, program modules, or other data. Computer storage media includes, but is not limited to memory devices (e.g., random access memory (RAM), read-only memory (ROM), electrically erasable programmable read-only memory (EEPROM) . . . ), magnetic storage devices (e.g., hard disk, floppy disk, cassettes, tape . . . ), optical disks (e.g., compact disk (CD), digital versatile disk (DVD) . . . ), and solid state devices (e.g., solid state drive (SSD), flash memory drive (e.g., card, stick, key drive . . . ) . . . ), or any other medium which can be used to store the desired information and which can be accessed by the computer 1110.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 1130 and mass storage 1150 are examples of computer-readable storage media. Depending on the exact configuration and type of computing device, memory 1130 may be volatile (e.g., RAM), non-volatile (e.g., ROM, flash memory . . . ) or some combination of the two. By way of example, the basic input/output system (BIOS), including basic routines to transfer information between elements within the computer 1110, such as during start-up, can be stored in nonvolatile memory, while volatile memory can act as external cache memory to facilitate processing by the processor(s) 1120, among other things.

Mass storage 1150 includes removable/non-removable, volatile/non-volatile computer storage media for storage of large amounts of data relative to the memory 1030. For example, mass storage 1150 includes, but is not limited to, one or more devices such as a magnetic or optical disk drive, floppy disk drive, flash memory, solid-state drive, or memory stick.

Memory 1130 and mass storage 1150 can include, or have stored therein, operating system 1160, one or more applications 1162, one or more program modules 1164, and data 1166. The operating system 1160 acts to control and allocate resources of the computer 1110. Applications 1162 include one or both of system and application software and can exploit management of resources by the operating system 1160 through program modules 1164 and data 1166 stored in memory 1130 and/or mass storage 1150 to perform one or more actions. Accordingly, applications 1162 can turn a general-purpose computer 1110 into a specialized machine in accordance with the logic provided thereby.

All or portions of the claimed subject matter can be implemented using standard programming and/or engineering techniques to produce software, firmware, hardware, or any combination thereof to control a computer to realize the disclosed functionality. By way of example and not limitation, the virtual lottery application 204 (associated functionality, modules, and/or portions thereof) can be, or form part, of an application 1162, and include one or more modules 1164 and data 1166 stored in memory and/or mass storage 1150 whose functionality can be realized when executed by one or more processor(s) 1120. Moreover, it is to be appreciated that the software, firmware, or combination thereof to perform the functionality of the described components herein can be downloaded, installed, or a combination thereof from any host. For instance, the host can be an online store, a website, an IP address, an application store, a network, a storage medium, a portable hard disk, a server, or the Internet.

In accordance with one particular embodiment, the processor(s) 1120 can correspond to a system on a chip (SOC) or like architecture including, or in other words integrating, both hardware and software on a single integrated circuit substrate. Here, the processor(s) 1120 can include one or more processors as well as memory at least similar to processor(s) 1120 and memory 1130, among other things. Conventional processors include a minimal amount of hardware and software and rely extensively on external hardware and software. By contrast, an SOC implementation of processor is more powerful, as it embeds hardware and software therein that enable particular functionality with minimal or no reliance on external hardware and software. For example, the virtual lottery application 204 (associated functionality, modules, and/or portions thereof) can be embedded within hardware in a SOC architecture.

The computer 1110 also includes one or more interface components 1170 that are communicatively coupled to the system bus 1140 and facilitate interaction with the computer 1110. By way of example, the interface component 1170 can be a port (e.g., serial, parallel, PCMCIA, USB, FireWire . . . ) or an interface card (e.g., sound, video . . . ) or the like. In one example implementation, the interface component 1170 can be embodied as a user input/output interface to enable a user to enter commands and information into the computer 1110 through one or more input devices (e.g., pointing device such as a mouse, trackball, stylus, touch pad, keyboard, microphone, joystick, game pad, satellite dish, scanner, camera, other computer . . . ). In another example implementation, the interface component 1170 can be embodied as an output peripheral interface to supply output to displays (e.g., CRT, LCD, plasma . . . ), speakers, printers, and/or other computers, among other things. Still further yet, the interface component 1170 can be embodied as a network interface to enable communication with other computing devices (not shown), such as over a wired or wireless communications link.

Figure 12:
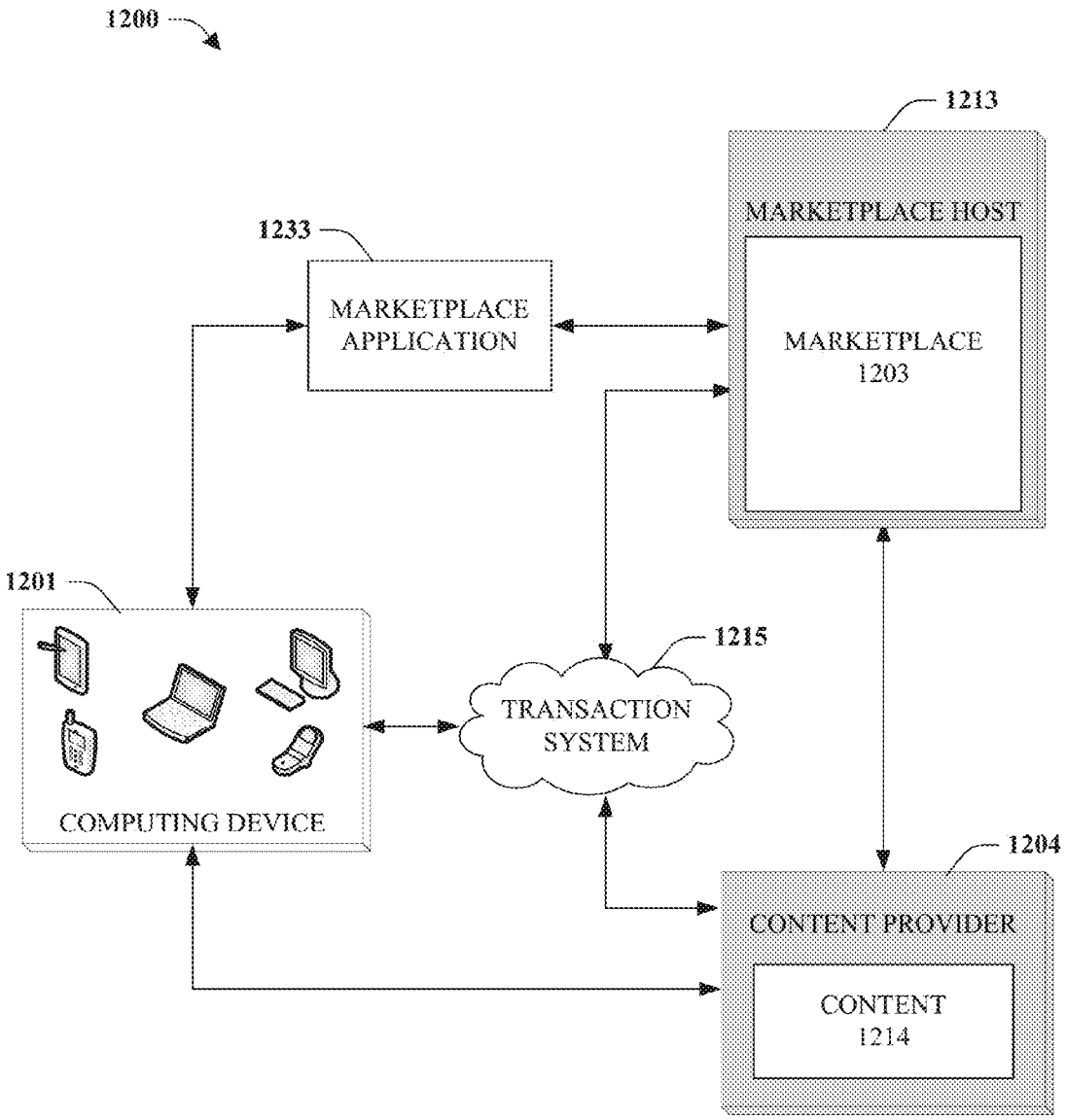
FIG. 12 is a schematic block diagram illustrating a suitable environment for delivery of data in accordance with the subject disclosure.

FIG. 12 illustrates an operating environment 1200 that can be used with the subject innovation and in particular, the virtual lottery application 204. The operating environment 1200 includes a computing device 1201 (e.g., device smartphone, a tablet, a laptop, a desktop machine, a portable gaming device, a device with Internet connectivity, among others), a user, a marketplace 103, a content provider 1204, and content 1214. The operating environment 1200 is configured to deliver data (e.g., content 1214) to the computing device 1201 based upon a request from the computing device 1201 (e.g., typically initiated by a user of the computing device 1201). However, it may be appreciated that the delivery of data to the computing device 1201 can be pushed to the computing device 1201 and further approved (e.g. acceptance of license agreement, among others) by the user. The data delivered can be from a content provider 1204, wherein the data can be delivered directly to the computing device 1201 or indirectly delivered to the computing device 1201 via the marketplace 1203 and/or the marketplace applications 1233. In an embodiment, the computing device 1201 can utilize a transaction system 1215 that facilitates purchasing data via at least one of the marketplace 1203, the marketplace applications 1233, the content provider 1204, and the like. The transaction system 1215 can be configured to utilize a charging gateway to facilitate completing a transaction between entities (e.g., user, content provider, marketplace, among others).

The computing device 1201 and the marketplace 1203 can be configured to communicate across a network, for example, wherein the marketplace 1203 is accessed via the marketplace application 1233 or a user interface (UI) associated with one of the marketplace 1203 or the marketplace host 1213. The marketplace 1203 can be hosted by a marketplace host 1213 associated with any suitable host, server, computer, data store, and the like.

In one embodiment, the computing device 1201 is mobile so that it may function for a period of time without requiring a physical connection to a power source or network provider. For example, a cellular network or a Wi-Fi connection can be used by the computing device 1201 in order to transmit and/or receive data within the operating environment 1200.

A user can employ the computing device 1201 for the device's intended functions as well as communicating data with the marketplace 1203 and/or marketplace host 1213. Commonly, the user purchases content 1214 and/or products from the content provider 1204 via the transaction system 1215. It is to be appreciated that the marketplace 1203 can be in an electronic form such as a website, the marketplace application 1233, or an executable program. In a preferred embodiment, the marketplace 1203 takes the form of the marketplace application 1233 configured to run on the user's computing device 1201. The marketplace application 1233 may be utilized to install the content 1214 from the content provider 1204 onto the computing device 1201.

The marketplace 1203 can further connect the content provider 1204 and/or the content 1214 of the content provider 1204 with the computing device 1201 to allow the user to receive content 1214 via a download (e.g., communication of data packets). The marketplace 1203 can offer the user a variety of content 1214 for purchase (via the transaction system 115) or for free of charge. The content 1214 offered by the marketplace 1203 may also come from the marketplace host 1213. For example, the content provider 1204 can have a website for direct delivery of content 1214 or have content 1214 hosted in the marketplace 1203 by the marketplace host 1213. Thus, in such an example, a user can directly receive data or content from the website of the content provider 1204 or use the marketplace application 1233 to identify the content 1214 for receipt through the marketplace 1203. Moreover, the content 1214 can be tailored to the computing device 1201. For instance, a first content can be built for a first computing device having a first operating system and a second content can be built for a second computing device having a second operating system, wherein the first content and the second content can be from the content provider 1204.

In some embodiments, the system 1200 utilizes the transaction system 1215. The transaction system 1215 can include a transaction gateway that facilitates transactions between at least the marketplace host 1213, one or more users, the marketplace 1203, and/or the content provider 1204. When the user purchases content 1214 from the marketplace 1203 or content provider 1204, a charging gateway can receive a request to apply a charge to a user account (e.g., a monetary value via an electronic transaction via an account) owned or authorized by the user. For example, the user account can be, but is not limited to being, a credit card account, an account with the content provider 1204 or marketplace host 1213, a bank account, a debit account, an e-commerce account (e.g. Pay-Pal®), an electronic account, a savings account, and the like.

The transaction gateway can store transaction data (e.g., user account, username, password, data related to the user, data related to the computing device 1201, among others) specific to a transaction to receive content 1214. The transaction gateway can further collect and/or store data regarding one or more users, wherein the data can be, but is not limited to, credit card numbers, to make it easier for the one or more users to engage in multiple transactions (e.g., simultaneously and/or various points in time). The transaction gateway can further reverse a transaction between one or more parties involved, such as providing a refund to the user.

It is to be appreciated that a purchase may not require the transfer of finances. For example, the content 1214 on the marketplace 1203 could be free to download. Additionally, a portion of the transaction system 1215 can be integrated into at least one of the content provider 1204, the marketplace host 1213, the marketplace application 1233, or a combination thereof. In another embodiment, the first content 1214 can be free but additional content related to the first content 1214 can require a purchase.

The content provider 1204 can create content 1214 (e.g., also referred to as products, software, apps, applications, and the like) that can be sold on the marketplace 1203. By way of example and not limitation, the content provider 1204 can be a videogame company that creates a game to be made available for download from the marketplace 1203. By way of another example and not limitation, a bank can develop a mobile banking application that is communicated to the marketplace 1203 and made available for download via the marketplace 1203. In such example, the bank is the content provider 1204. Additionally, the bank may host the mobile banking application on the bank's website for download or delivery to users. It is to be appreciated and understood that the content provider 1204 is not limited to these examples and the content provider 1204 can be any suitable entity (e.g., user, company, business, group of users, and the like) that creates or develops content 1214 to be distributed to the marketplace host 1213 for download via the marketplace 1203.

The marketplace host 1213 maintains the marketplace 1203 on a network. The marketplace host 1213 owns and/or controls a host server that contains the marketplace 1203, and provides the user access to the marketplace 1203. The marketplace host 1213 can further control an amount of bandwidth allocated to the user to download the content 1214 of the one or more content providers 1204. In a non-limiting embodiment, the marketplace host 1213 can own and/or control the marketplace 1203. In another non-limiting embodiment, the marketplace host 1213 can host the marketplace 1203 on a network to enable access by the user.

In an exemplary embodiment, a user accesses the marketplace 1203 via the marketplace application 1233 located on the computing device 1201. The computing device 1201 can have access to the network 1205, and the computing device 1201 can communicate data in the form of a query to the marketplace host 1213, wherein the data can be a request for information on content 1214. The marketplace host 1213 can communicate data in the form of a query result (which can include content 1214) via a network to the computing device 1201 for review, install, use, storage, and the like. In a non-limiting embodiment, the computing device 1201 can include a user-interface that displays the data (e.g., the query, the query result, the content 1214, among others) for the user.

Prior to download of content 1214, the user can further navigate information regarding the content 1214 that is displayed and select to either request additional content 1214 or to purchase the content 1214. If the user selects to purchase content 1214, the marketplace application 1233 communicates a purchase request to the marketplace host 1213. The marketplace host 1213 can then use the transaction system 1215 which includes the transaction gateway charging the user account if data related to the user account is available, and if the user account is not available, then the marketplace host 1213 can request user account 1212 information from the user which can then be sent to the transaction gateway. Upon receipt of the user account information, the transaction gateway can charge the user account, and send a confirmation of the transaction back to the marketplace host 1213.

The marketplace host 1213 can then communicate the confirmation information to the computing device 1201, as well as enable the user to download data for the content 1214 and/or the marketplace application 1233 stored in a host server regarding the specific content 1214 and/or marketplace application 1233 purchased. The marketplace application 1233 can further assist with installation of the content 1214 or marketplace application 1233 purchased onto the computing device 1201. It is to be appreciated and understood that the above process can occur in any order, such as a downloading of application information from the marketplace host 1213 prior to the transaction and the order of the above described process is not to be limiting on the subject innovation.

One of ordinary skill in the art can appreciate that the various embodiments of a virtual lottery application described herein can be implemented in connection with any computing device, client device, or server device, which can be deployed as part of a computer network or in a distributed computing environment such as the cloud. The various embodiments described herein can be implemented in substantially any computer system or computing environment having any number of memory or storage units, any number of processing units, and any number of applications and processes occurring across any number of storage units and processing units. This includes, but is not limited to, cloud environments with physical computing devices (e.g., servers) aggregating computing resources (i.e., memory, persistent storage, processor cycles, network bandwidth, etc.) which are distributed among a plurality of computable objects. The physical computing devices can intercommunicate via a variety of physical communication links such as wired communication media (e.g., fiber optics, twisted pair wires, coaxial cables, etc.) and/or wireless communication media (e.g., microwave, satellite, cellular, radio or spread spectrum, free-space optical, etc.). The physical computing devices can be aggregated and exposed according to various levels of abstraction for use by application or service providers, to provide computing services or functionality to client computing devices. The client computing devices can access the computing services or functionality via application program interfaces (APIs), web browsers, or other standalone or networked applications. Accordingly, aspects of the virtual lottery application can be implemented based on such a cloud environment. For example, the virtual lottery application 202 can reside in the cloud environment such that the computer-executable instruction implementing the functionality thereof are executed with the aggregated computing resources provided by the plurality of physical computing devices. The cloud environment provides one or more methods of access to the subject innovation, which are utilized the virtual lottery application 202. In an embodiment, software and/or a component can be installed on a mobile device to allow data communication between the mobile device and the cloud environment. These methods of access include IP addresses, domain names, URLs, etc. Since the aggregated computing resources can be provided by physical computing device remotely located from one another, the cloud environment can include additional devices such as a routers, load balancers, switches, etc., that appropriately coordinate network data.

Figure 13:
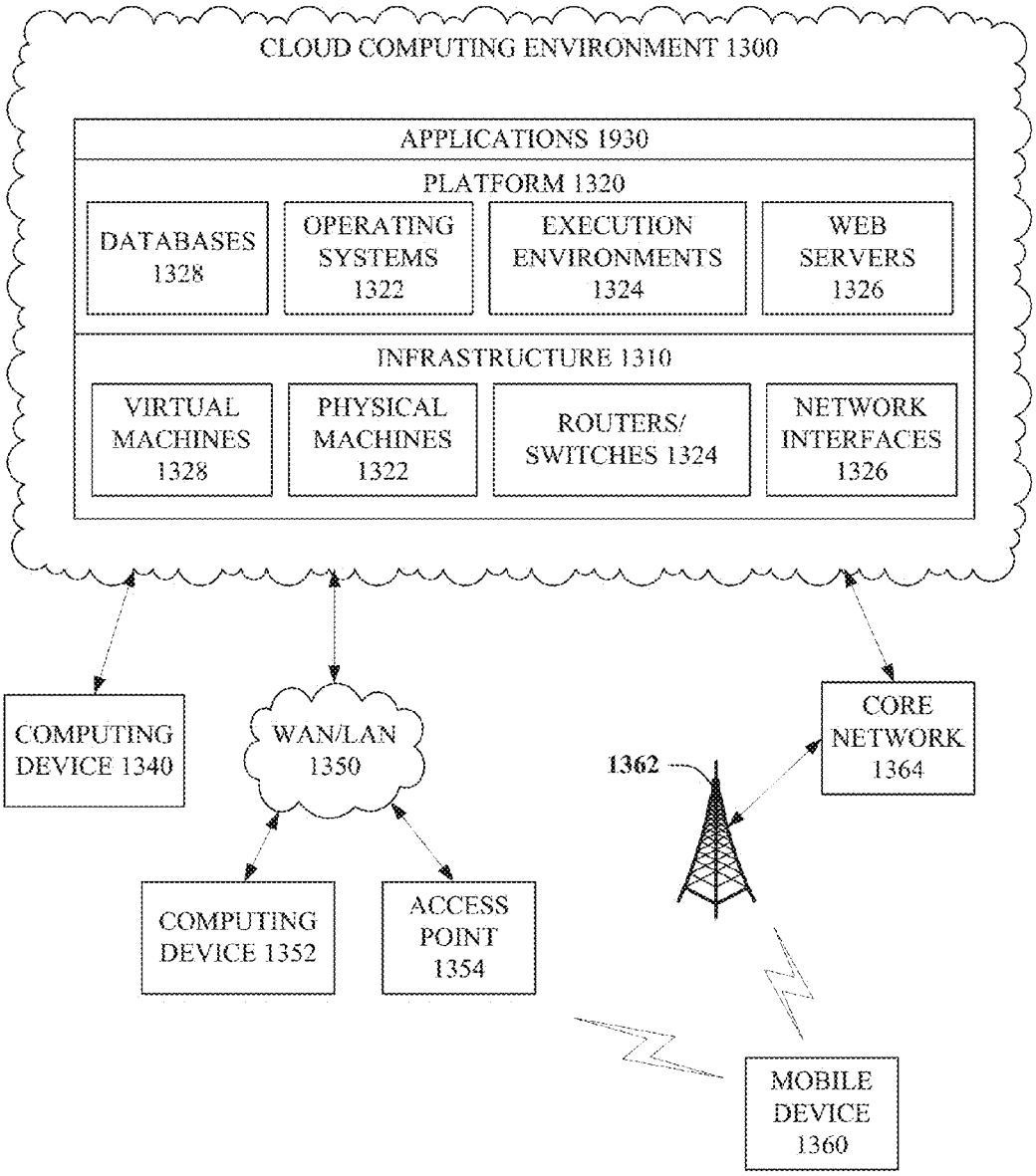
FIG. 13 is a schematic block diagram illustrating illustrates a cloud computing environment in accordance with the subject innovation.

FIG. 13 provides a schematic diagram of an exemplary networked or distributed computing environment, such as a cloud computing environment 1300. The cloud computing environment 1300 represents a collection of computing resources available, typically via the Internet, to one or more client devices. The cloud computing environment 1300 comprises various levels of abstraction: infrastructure 1310, a platform 1320, and applications 1330. Each level, from infrastructure 1310 to applications 1330 is generally implemented on top of lower levels, with infrastructure 1310 representing the lowest level.

Infrastructure 1310 generally encompasses the physical resources and components on which cloud services are deployed. For instance, infrastructure 1310 can include virtual machines 1312, physical machines 1314, routers/switches 1316, and network interfaces 1318. The network interfaces 1318 provide access to the cloud computing environment 1300, via the Internet or other network, from client devices such as computing devices 1340, 1352, 1360, etc. That is, network interfaces 1318 provide an outermost boundary of cloud computing environment 1300 and can couple the cloud computing environment 1300 to other networks, the Internet, and client computing devices. Routers/switches 1316 couple the network interfaces 1318 to physical machines 1314, which are computing devices comprising computer processors, memory, mass storage devices, etc. Hardware of physical machines 1314 can be virtualized to provide virtual machines 1312. In an aspect, virtual machines 1312 can be executed on one or more physical machines 1314. That is, one physical machine 1314 can include a plurality of virtual machines 1312.

Implemented on infrastructure 1310, platform 1320 includes software that forming a foundation for applications 1330. The software forming platform 1320 includes operating systems 1322, programming or execution environments 1324, web servers 1326, and databases 1328. The software of platform 1320 can be installed on virtual machines 1312 and/or physical machines 1314.

Applications 1330 include user-facing software applications, implemented on platform 1320, that provide services to various client devices. In this regard, at least the virtual lottery application 204 as described herein is an example application 1330. As illustrated in FIG. 13, client devices can include computing devices 1340, 1352 and mobile device 1360. Computing devices 1340, 1352 can be directly coupled to the Internet, and therefore the cloud computing environment 1300, or indirectly coupled to the Internet via a WAN/LAN 1350. The WAN/LAN 1350 can include an access point 1354 that enables wireless communications (e.g., WiFi) with mobile device 1360. In this regard, via access point 1354 and WAN/LAN 1350, mobile device 1360 can communicate wirelessly with the cloud computing environment 1300. Mobile device 1360 can also wirelessly communicate according to cellular technology such as, but not limited to, GSM, LTE, WiMAX, HSPA, etc. Accordingly, mobile device 1360 can wireless communicate with a base station 1362, which is coupled to a core network 1364 of a wireless communication provider. The core network 1364 includes a gateway to the Internet and, via the Internet, provides a communication path to the cloud computing environment 1300.

Figure 14:
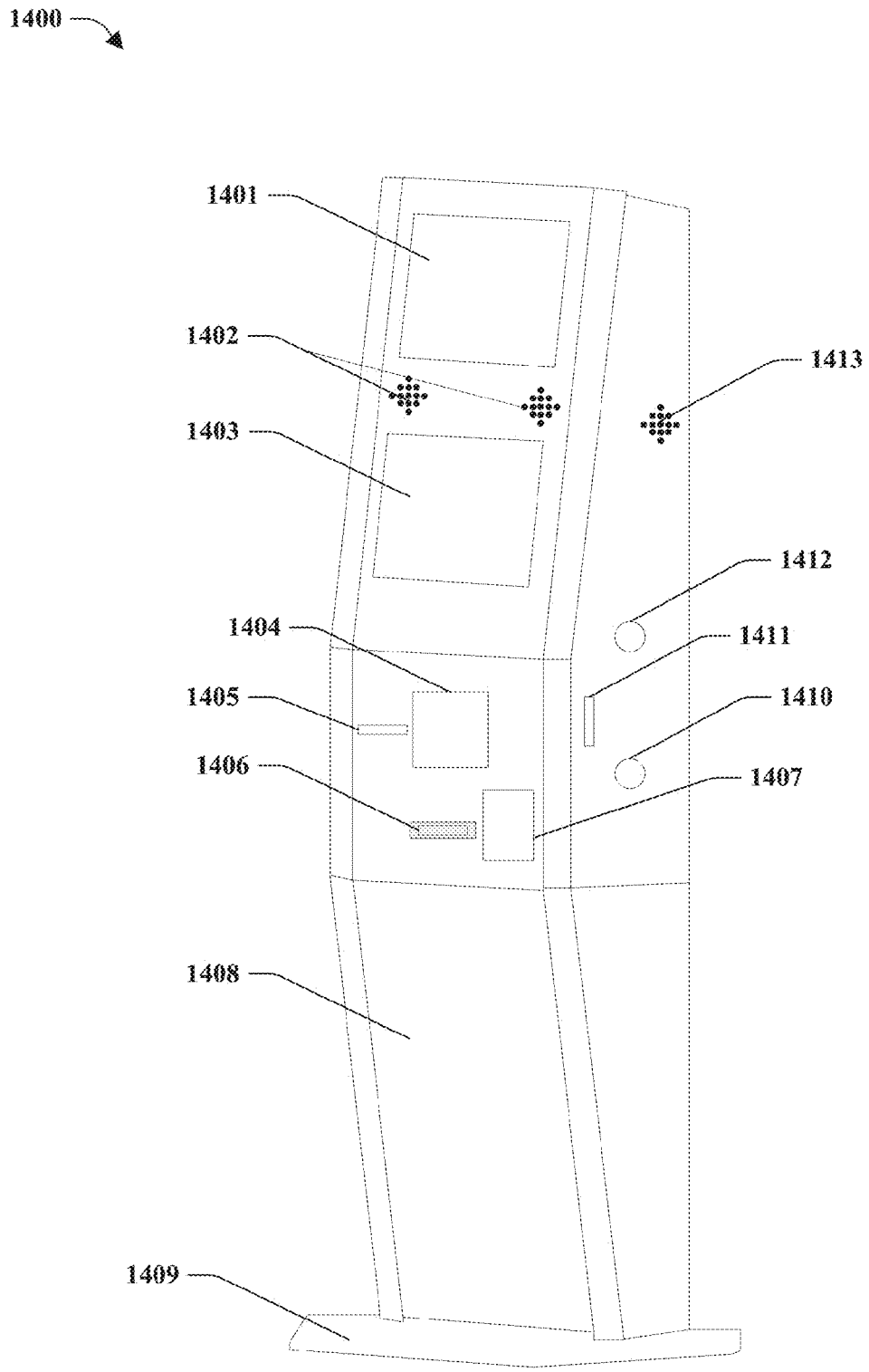
FIG. 14 is an illustration of a lottery device in accordance with the subject innovation.

Turning to FIG. 14, a lottery device 1400 is illustrated in accordance with the subject innovation. It is to be appreciated that the lottery device 1400 is depicted solely for example and not to be limiting on the subject innovation. In particular, the lottery device 1400 can be a device in communication with a lottery authority. For example, the lottery device 1400 can be a master terminal or a slave terminal. In another example, the lottery device 1400 can be a master terminal that includes the virtual lottery application. In still another embodiment, the lottery device 1400 can be a slave terminal that includes the virtual lottery application. In still another example, the lottery device 1400 can be a master virtual device that includes the virtual lottery application. The lottery device 1400 depicted herein is to provide a description of a lottery device that can employ the subject innovation and is not to be limiting on the type of device that can use the subject innovation or limit how to employ or implement of the subject innovation.

The lottery device 1400 can include an advertising display 1401, a front speaker system 1402, an interactive display 1403, a bar code reader device 1404, a thermal printer output 1405, a bet card reader input 1406, a bill/payment acceptor/validator device 1407, a base 1408, a footrest 1409, a main door key lock 1410, a main door handle 1411, a maintenance switch lock 1412, and an additional speaker 1413.

Figure 15:
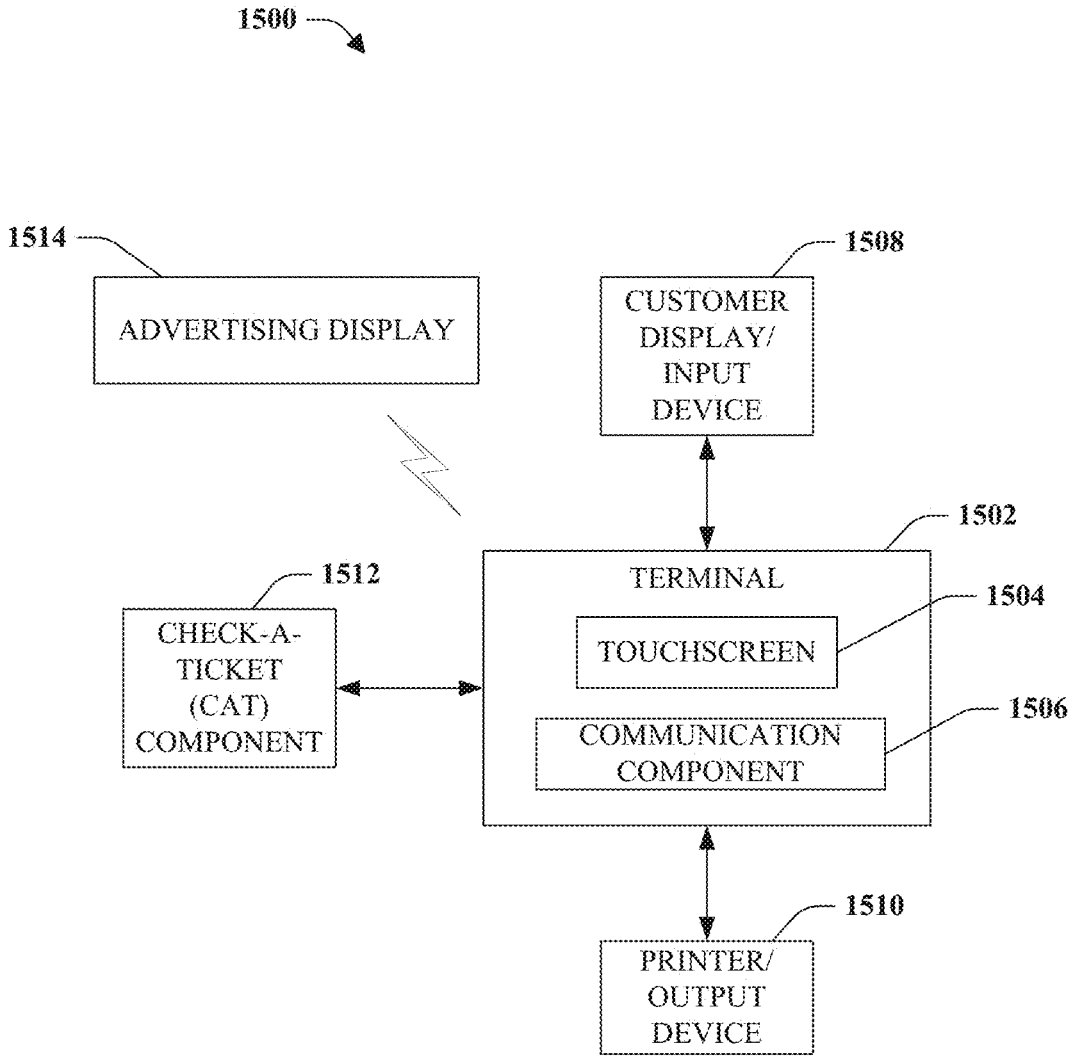
FIG. 15 is an illustration of a lottery device in accordance with the subject innovation.

FIG. 15 illustrates a gaming equipment 1500 that can output a lottery ticket for a lottery game upon receipt of a payment. It is to be appreciated that the gaming device 1500 is depicted solely for example and not to be limiting on the subject innovation. In particular, the gaming device 1500 can be a device in communication with at least one of a lottery authority, a master terminal, or a master virtual device. Moreover, the term "gaming equipment" is defined herein to include a device or component that is utilized with a portion of a lottery ticket or lottery gaming system.

The gaming equipment 1500 can include a terminal 1502 that can perform functionalities described above related to a master terminal and/or a slave terminal. The terminal 1502 can receive and process a request for a lottery ticket. The terminal 1502 can include a touchscreen 1504 to receive input from a user (e.g., merchant, player, etc.) to order a lottery ticket. The terminal can also include a communication component 1506 that is configured to transmit and/or receive data. For example, the terminal 1502 can communicate data via the communication component 1506 to display on an advertising display 1514 such as a lottery winnings jackpot. In another example, the communication component 1506 can receive data from a lottery authority. In still another example, the communication component 1506 can transmit data to the lottery authority. The data communication component 1506 can employ wired or wireless communication with components or devices related to a lottery system such as, but not limited to, the advertising display 1514, a lottery authority, a master terminal, a slave terminal, a master virtual device, a virtual lottery application, a printer/output device 1510, a customer display/input device 1508, a check-a-ticket (CAT) component 1512, among others.

The terminal 1502 can further include the customer display/input device 1508 that can be used to display data to a user and/or receive input (e.g., via a touchscreen for example) on which lottery games the user wishes to play. The terminal 1502 is further in communication with the printer/output device 1510. The printer/output device 1510 can print a physical lottery ticket or game for the user based on an accepted payment. It is to be appreciated that the printer/output device 1510 can be configured for the subject innovation to output a soft copy via the communication component 1506 or a communication device incorporated into the printer/output device 1510. The terminal 1502 can further include the check-a-ticket (CAT) component 1512 that is configured to verify a ticket a user is turning in to receive a winnings from a lottery game.

The terminal 1502 can include one or more screens having various menus or displayed options that can be selected via the touchscreen 1504. It is to be appreciated that the terminal 1502 can be used to diagnose equipment, test equipment, receive payment for a lottery ticket, print/output a lottery ticket, verify a lottery ticket, cash out a lottery ticket, display advertisements, calculate sales data, calculate or track sales, store/output receipt data, store/output commission sales information, and the like.

In an embodiment, a system is provided that includes a lottery authority device that is configured to communicate a confirmation that includes a set of lottery numbers for a draw game in response to a request, a master terminal that is in electric communication with the lottery authority device via a first data connection and is physically located at a site of a merchant, and a master terminal virtual device that is in electronic communication with the master terminal. The master terminal can be configured to perform the following: receive a first set of requests for a hard copy of one or more lottery tickets from an input device of the master terminal; receive a second set of requests for a soft copy of one or more lottery tickets from the master virtual device; communicate the first set of requests or the second set of requests to the lottery authority device; receive a confirmation from the lottery authority device that includes a set of lottery numbers for a draw game that satisfies the first set of requests or the second set of requests; output the hard copy of the one or more lottery tickets based on a receipt of payment and the confirmation; communicate the confirmation, which includes the set of lottery numbers for the draw game that satisfies the second set of requests, to the master virtual device; and store a first data portion representative of a number of physical sales for the draw game via the master terminal physically located at the site of the merchant. The master virtual device can be further configured to communicate via a second data connection to a mobile device, wherein the second data connection is the Internet and further configured to perform the following: receive the second set of requests for the soft copy of one or more lottery tickets from a mobile device via the second data connection; communicate the second set of requests to the master terminal; receive the confirmation, which includes the set of lottery numbers for the draw game that satisfies the second set of requests; communicate the soft copy of the one or more lottery tickets based on a receipt of the confirmation from the master terminal, and a payment from the mobile device; and store a second data portion representative of a number of online sales for the draw game via the virtual master device in electronic communication with the master terminal, which is physically located at the site of the merchant.

In the embodiment, the first set of request or the second set of request includes a random number pick for the set of lottery numbers or a user selected number pick for the set of lottery numbers. In the embodiment, the lottery authority is further configured to distribute a first payment to the merchant based on the first data portion representative of the number of physical sales for the draw game via the master terminal physically located at the site of the merchant, wherein the first payment is at a first percentage. In the embodiment, the lottery authority is further configured to distribute a second payment to the merchant based on the second data portion for compensation of the number of online sales for the draw game via the virtual master device in electronic communication with the master terminal which is physically located at the site of the merchant, wherein the second payment is at a second percentage. In the embodiment, a slave terminal is provided that is in electronic communication with the master terminal, wherein the slave terminal is further configured to perform the following: receive the first set of requests for a hard copy of one or more lottery tickets from an input device of the slave terminal; communicate the first set of requests to the master terminal; output the hard copy of the one or more lottery tickets based on a receipt of payment and the confirmation.

In the embodiment, the master virtual device is in electronic communication with the slave terminal and the master virtual device is further configured to perform the following: communicate the second set of requests to the slave terminal; and communicate the soft copy of the one or more lottery tickets based on a receipt of the confirmation from the slave terminal or the master terminal, and a payment from the mobile device; and the slave terminal is further configured to perform the following: receive the second set of requests from the master virtual device; communicate the second set of requests to the master terminal.

In the embodiment, the master virtual device further configured to perform the following: format the second set of requests to a first format of the first set of requests, wherein the lottery authority accepts and processes the second set of requests as the first set of requests. In the embodiment, the master virtual device further configured to perform the following: track a number of the first set of requests communicated to the lottery authority; track a number of the second set of requests communicated to the lottery authority; and adjust, by increasing or decreasing, the number of the second set of requests based on a comparison of a total of the first set of requests and the second set of requests to a pre-defined threshold.

In an embodiment, the system can include an additional master terminal that is in electronic communication with the master terminal and the master virtual device and the master virtual device further configured to perform the following: track a number of the second set of requests received from one or more mobile devices; compare the number of the second set of requests to a threshold; communicate a portion of the second set of requests to the additional master terminal based on the number of the second set of requests exceeding the threshold. In the embodiment, the additional master virtual terminal further configured to perform the following: receive the portion of the second set of requests for the soft copy of one or more lottery tickets; communicate the portion of the second set of requests to the lottery authority; receive the confirmation, which includes the set of lottery numbers for the draw game that satisfies the second set of requests; communicate the soft copy of the one or more lottery tickets based on a receipt of the confirmation from the master terminal, and a payment from the mobile device In an embodiment, the master terminal further includes a touchscreen in electronic communication with the master terminal, the touchscreen receives an input for a selection of the draw game; a customer input device in electronic communication with the master terminal, the customer input device receives a user selected number for the draw game; the master terminal further receives the user selected number for the draw game; and a printer device, in electronic communication with the master terminal that outputs the lottery ticket in response to the confirmation from the master terminal.

In an embodiment, a method of distributing a lottery ticket for entry to participate in a lottery game, is provided that includes at least one of the following: establishing a data connection between a lottery authority and a master terminal located at a physical location of a merchant that sells one or more lottery tickets for a lottery game; employing a user interface with the master terminal or a slave terminal, electronically coupled thereto, to sell a hard copy of the one or more lottery tickets from the lottery authority; receiving, from a mobile device, a submitted payment and a user selected number for the lottery game to sell a soft copy of the one or more lottery tickets from the lottery authority; communicating a data package to the master terminal, the data package includes data representative of the submitted payment and the user selected number for the lottery game; formatting the data package to replicate a format used for data communicated between the slave terminal and the master terminal; receiving a confirmation from the master terminal for the user selected number for the lottery game; and communicating the soft copy of the one or more lottery tickets from the lottery authority based on the confirmation from the master terminal.

In the embodiment, the method can include tracking a number of sales for the hard copy of the one or more lottery tickets, wherein the number of sales corresponds to the physical location of the merchant. In the embodiment, the method can include tracking a number of sales for the soft copy of the one or more lottery tickets, wherein the number of sales corresponds to the physical location of the merchant. In the embodiment, the method can include outputting the hard copy of the one or more lottery tickets from the lottery authority based on the confirmation from the master terminal.

In an embodiment, a lottery gaming system is provided that includes a master terminal that is in electronic communication with a lottery authority device which distributes a lottery ticket for a lottery game and the master terminal includes a memory, a processor that executes instructions stored on the memory, a display, and an input device. The lottery gaming system can further include a printer that is in electronic communication with the master terminal and an output device that is in electronic communication with the master terminal. In the embodiment, the master terminal is further configured to perform the following: receive a first set of requests for a hard copy of one or more lottery tickets from the input device of the master terminal; receive a second set of requests for a soft copy of one or more lottery tickets from a mobile device; communicate the first set of requests and the second set of requests to the lottery authority device; receive a confirmation from the lottery authority device that includes a set of lottery numbers for a draw game that satisfies the first set of requests and the second set of requests; output the hard copy of the one or more lottery tickets for the first set of requests based on a receipt of payment and the confirmation; communicate the soft copy of the one or more lottery tickets for the second set of requests based on a receipt of payment and the confirmation; store a first data portion representative of a number of physical sales for the draw game; and store a second data portion representative of a number of online sales for the draw game.

In the embodiment, the lottery gaming system can further include a slave terminal that is in electronic communication with the master terminal, the slave terminal is further configured to perform the following: receive the first set of requests for a hard copy of one or more lottery tickets from an input device of the slave terminal; communicate the first set of requests to the master terminal; and output the hard copy of the one or more lottery tickets based on a receipt of payment and the confirmation.

In the embodiment, the slave terminal is further configured to perform the following: receive a second set of requests for a soft copy of one or more lottery tickets from a mobile device; and communicate the soft copy of the one or more lottery tickets for the second set of requests based on a receipt of payment and the confirmation.

In the embodiment, the input device of the master terminal is a touchscreen. In the embodiment, the slave terminal communicates with the master terminal via a wireless connection. In the embodiment, the master terminal communicates with the lottery authority device via a wired connection.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of"may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the invention, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A system, comprising:

a lottery authority device that is configured to communicate a confirmation that includes a set of lottery numbers for a draw game in response to a request;

a master terminal that is in electric communication with the lottery authority device via a first data connection and is physically located at a site of a merchant;

a master virtual device that is in electronic communication with the master terminal;

the master virtual device is further configured to perform the following:

receive a first set of requests for a hard copy of one or more lottery tickets from an input device of the master terminal;

receive a second set of requests for a soft copy of one or more lottery tickets from the master virtual device;

communicate the first set of requests or the second set of requests to the lottery authority device;

receive a confirmation from the lottery authority device that includes a set of lottery numbers for a draw game that satisfies the first set of requests or the second set of requests;

output the hard copy of the one or more lottery tickets based on a receipt of payment and the confirmation;

communicate the confirmation, which includes the set of lottery numbers for the draw game that satisfies the second set of requests, to the master virtual device; and store a first data portion representative of a number of physical sales for the draw game via the master terminal physically located at the site of the merchant;

the master virtual device is further configured to communicate via a second data connection to a mobile device, wherein the second data connection is the Internet;

the master virtual device is further configured to perform the following:

receive the second set of requests for the soft copy of one or more lottery tickets from a mobile device via the second data connection;

communicate the second set of requests to the master terminal;

receive the confirmation, which includes the set of lottery numbers for the draw game that satisfies the second set of requests;

communicate the soft copy of the one or more lottery tickets based on a receipt of the confirmation from the master terminal, and a payment from the mobile device;

store a second data portion representative of a number of online sales for the draw game via the virtual master device in electronic communication with the master terminal which is physically located at the site of the merchant;

track a number of the first set of requests communicated to the lottery authority;

track a number of the second set of requests communicated to the lottery authority; and adjust, by increasing or decreasing, the number of the second set of requests based on a comparison of a total of the first set of requests and the second set of requests to a pre-defined threshold.

2. The system of claim 1, wherein the first set of request or the second set of request includes a random number pick for the set of lottery numbers or a user selected number pick for the set of lottery numbers.

3. The system of claim 1, the lottery authority is further configured to distribute a first payment to the merchant based on the first data portion representative of the number of physical sales for the draw game via the master terminal physically located at the site of the merchant, wherein the first payment is at a first percentage.

4. The system of claim 3, the lottery authority is further configured to distribute a second payment to the merchant based on the second data portion for compensation of the number of online sales for the draw game via the virtual master device in electronic communication with the master terminal which is physically located at the site of the merchant, wherein the second payment is at a second percentage.

5. The system of claim 1, further comprising a slave terminal that is in electronic communication with the master terminal, the slave terminal is further configured to perform the following:

receive the first set of requests for a hard copy of one or more lottery tickets from an input device of the slave terminal;

communicate the first set of requests to the master terminal;

output the hard copy of the one or more lottery tickets based on a receipt of payment and the confirmation.

6. The system of claim 5, further comprising the master virtual device is in electronic communication with the slave terminal;

the master virtual device is further configured to perform the following:

communicate the second set of requests to the slave terminal; and communicate the soft copy of the one or more lottery tickets based on a receipt of the confirmation from the slave terminal or the master terminal, and a payment from the mobile device; and the slave terminal is further configured to perform the following:

receive the second set of requests from the master virtual device; and communicate the second set of requests to the master terminal.

7. The system of claim 1, the master virtual device further configured to perform the following:

format the second set of requests to a first format of the first set of requests, wherein the lottery authority accepts and processes the second set of requests as the first set of requests.

8. The system of claim 1, further comprising:

an additional master terminal that is in electronic communication with the master terminal and the master virtual device;

the master virtual device further configured to perform the following:

track a number of the second set of requests received from one or more mobile devices;

compare the number of the second set of requests to a threshold;

communicate a portion of the second set of requests to the additional master terminal based on the number of the second set of requests exceeding the threshold;

the additional master terminal further configured to perform the following:

receive the portion of the second set of requests for the soft copy of one or more lottery tickets;

communicate the portion of the second set of requests to the lottery authority device;

receive the confirmation, which includes the set of lottery numbers for the draw game that satisfies the second set of requests;

communicate the soft copy of the one or more lottery tickets based on a receipt of the confirmation from the master terminal, and a payment from the mobile device.

9. The system of claim 1, the master terminal further comprising:

a touchscreen in electronic communication with the master terminal, the touchscreen receives an input for a selection of the draw game;

a customer input device in electronic communication with the master terminal, the customer input device receives a user selected number for the draw game;

the master terminal further receives the user selected number for the draw game; and a printer device, in electronic communication with the master terminal, that outputs the lottery ticket in response to the confirmation from the master terminal.

10. A method of distributing a lottery ticket for entry to participate in a lottery game, comprising:

establishing a data connection between a lottery authority and a master terminal located at a physical location of a merchant that sells one or more lottery tickets for a lottery game;

employing a user interface with the master terminal or a slave terminal, electronically coupled thereto, to sell a hard copy of the one or more lottery tickets from the lottery authority;

receiving, from a mobile device, a submitted payment and a user selected number for the lottery game to sell a soft copy of the one or more lottery tickets from the lottery authority;

communicating a data package to the master terminal, the data package includes data representative of the submitted payment and the user selected number for the lottery game;

formatting the data package to replicate a format used for data communicated between the slave terminal and the master terminal;

receiving a confirmation from the master terminal for the user selected number for the lottery game;

communicating the soft copy of the one or more lottery tickets from the lottery authority based on the confirmation from the master terminal;

tracking a number of the hard copy of the one or more lottery tickets communicated to the lottery authority;

tracking a number of the soft copy of the one or more lottery tickets communicated to the lottery authority; and adjusting, by increasing or decreasing, the number of the soft copy of the one or more lottery tickets communicated to the lottery authority based on a comparison of a total of the number of the hard copy of the one or more lottery tickets and the number of the soft copy of the one or more lottery tickets to a pre-defined threshold.

11. The method of claim 10, further comprising tracking a number of sales for the hard copy of the one or more lottery tickets, wherein the number of sales corresponds to the physical location of the merchant.

12. The method of claim 11, further comprising tracking a number of sales for the soft copy of the one or more lottery tickets, wherein the number of sales corresponds to the physical location of the merchant.

13. The method of claim 10, further comprising outputting the hard copy of the one or more lottery tickets from the lottery authority based on the confirmation from the master terminal.

14. A lottery gaming system, comprising:

a master terminal that is in electronic communication with a lottery authority device which distributes a lottery ticket for a lottery game;

the master terminal includes a memory, a processor that executes instructions stored on the memory, a display, and an input device;

a printer that is in electronic communication with the master terminal;

an output device that is in electronic communication with the master terminal;

the master terminal is further configured to perform the following:

receive a first set of requests for a hard copy of one or more lottery tickets from the input device of the master terminal;

receive a second set of requests for a soft copy of one or more lottery tickets from a mobile device;

communicate the first set of requests and the second set of requests to the lottery authority device;

receive a confirmation from the lottery authority device that includes a set of lottery numbers for a draw game that satisfies the first set of requests and the second set of requests;

output the hard copy of the one or more lottery tickets for the first set of requests based on a receipt of payment and the confirmation;

communicate the soft copy of the one or more lottery tickets for the second set of requests based on a receipt of payment and the confirmation store a first data portion representative of a number of physical sales for the draw game;

store a second data portion representative of a number of online sales for the draw game;

track a number of the first set of requests;

track a number of the second set of requests; and adjust, by increasing or decreasing, the number of the second set of requests based on a comparison of a total of the number of the first set of requests and the number of the second set of requests to a pre-defined threshold.

15. The lottery gaming system of claim 14, further comprising a slave terminal that is in electronic communication with the master terminal, the slave terminal is further configured to perform the following:

receive the first set of requests for a hard copy of one or more lottery tickets from an input device of the slave terminal;

communicate the first set of requests to the master terminal; and output the hard copy of the one or more lottery tickets based on a receipt of payment and the confirmation.

16. The lottery gaming system of claim 15, the slave terminal is further configured to perform the following:

receive a second set of requests for a soft copy of one or more lottery tickets from a mobile device; and communicate the soft copy of the one or more lottery tickets for the second set of requests based on a receipt of payment and the confirmation.

17. The lottery gaming system of claim 15, the slave terminal communicates with the master terminal via a wireless connection.

18. The lottery gaming system of claim 17, the master terminal communicates with the lottery authority device via a wired connection.

19. The lottery gaming system of claim 14, the input device of the master terminal is a touchscreen.

* * * * *